US005945972A

United States Patent [19]

Okumura et al.

[11] Patent Number: 5,945,972

[45] Date of Patent: Aug. 31, 1999

[54] DISPLAY DEVICE

[75] Inventors: Haruhiko Okumura, Fujisawa; Hisao Fujiwara; Katsuya Tsuchida, both of Yokohama; Goh Itoh, Tokyo, all of Japan

[73] Assignee: Kabushiki Kaisha Toshiba, Kawasaki, Japan

[21] Appl. No.: 08/758,014

[22] Filed: Nov. 27, 1996

[30] Foreign Application Priority Data

Nov. 30, 1995 [JP] Japan ..... 7-312141

[51] Int. Cl.[6] ..... G09G 3/36

[52] U.S. Cl. ..... 345/98; 345/100; 345/90

[58] Field of Search ..... 345/98, 90, 91, 345/92, 93, 97, 100, 104, 173, 207

[56] References Cited

U.S. PATENT DOCUMENTS 5,627,557 5/1997 Yamaguchi ..... 345/90

5,712,652 1/1998 Sato et al. ..... 345/90

OTHER PUBLICATIONS

A. Juliana, et al. "7.3/2:40 P.M.: Thin–Film Polysilicon Devices for Flat–Panel Display Circuitry", SID 82 DIGEST, (pp. 38–39), 1982.

*Primary Examiner*—Xiao Wu
*Assistant Examiner*—Vanel Frenel
*Attorney, Agent, or Firm*—Oblon, Spivak, McClelland, Maier & Neustadt, P.C.

[57] ABSTRACT

A display device includes a substrate, a plurality of pixels arranged in rows and columns on the substrate, and a plurality of signal lines for providing an image signal to the pixels on a column-by-column basis. Each of the pixels comprises a plurality of memory elements for storing image signals sent over a corresponding one of the signal lines, a selector for selecting one of the memory elements, and a display element for displaying a dot at a brightness corresponding to an image signal stored in the selected memory elements.

20 Claims, 18 Drawing Sheets

DISPLAY DEVICE

BACKGROUND OF THE INVENTION

1. Field of the Invention

The invention relates to a display device that makes a display with pixels arranged in rows and columns, and more specifically to a display device that has memory circuits each of which stores an image signal for a respective one of the pixels and that controls the writing of image signals into the pixels from the memory circuits in accordance with control signals.

2. Description of the Related Art

In recent years, digital information equipment, such as personal computers, has achieved a remarkably high level of performance and their information processing capabilities have advanced by leaps and bounds. Correspondingly, display devices for displaying the results of information processing have also attained a significant increase in display capacity.

However, conventionally used CRT (cathode ray tube) display devices have increased their size as the displays have increased in screen size and display capacity. In particular, an increase in the depth, weight and power dissipation becomes a problem. To solve the problem, flat panel displays, particularly liquid crystal displays (LCDs), have been used. However, the LCDs, which are very difficult to manufacture, have not been up to the level of the CRTs in screen size and resolution.

With the LCDs, digital signals are used for display signal connection with digital information equipment. Thus, in comparison with CRTs in which analog signals are used, the number of signal lines to be connected increases significantly. In addition, image signals need to be transferred at high rates. The high-rate transmission of image signals each of many bits results in the generation of electromagnetic noise and an increase in signal transmission power.

Moreover, an increase in the amount of image data to be transmitted results in an increase in the time required to update the display contents on a screen. The updating of the entire screen is slow in comparison with the updating of only a small area of the screen. Thus, motion-image display degradation will occur due to the slowdown of the movement of moving objects on screen.

In recent years, multi-window systems have been increasingly used in which a plurality of images are displayed on screen. A window image which has been hidden below other images after being displayed once must be retransferred via a video memory as with motion images. Thus, power dissipation increases every time images are switched from one to another. In addition, a time delay involved in switching images increases.

For the LCDs, under these circumstances, the power dissipation has been reduced by making their driving voltages or driving frequencies lower. As a structure that allows a further decrease in power dissipation, a structure that is equipped with a memory for each pixel has been proposed (Japanese Unexamined Patent Publication No. 58-196582 or No. 3-77922).

According to this technique, for a still image, once an image signal has been sent to each pixel, it can be driven constantly by the signal retained by its associated memory. Therefore, in theory, the power is dissipated only in reversing polarity and hence the power dissipation is approaching zero.

In recent years, however, multimedia systems have been increasingly used, so that the display of motion images is in increasing demand. In motion images, pixel information changes at a high rate. Even if each pixel has a memory, therefore, it is required that the memory be rewritten into at a high frequency. Such high-rate rewriting of pixels will result in a considerable increase in power dissipation as with the conventional LCDs.

With the pixel-memory-equipped LCD described previously, image data are held in each pixel memory and the memory contents are used to display the pixel. For still image display, this helps reduce the driving frequency and the static power dissipation. For motion image display, however, it is naturally required to increase the driving frequency, which will result in an increase in the whole power dissipation.

In particular, the display of motion images has become essential with the recent spread of multimedia. The LCDs are often used in portable equipment, such as portable personal computers, hand-held terminals, portable TV sets, cellular phones, electronic notebooks, game machines, etc. Therefore, the power dissipation problem with LCDs is one of important problems to be solved.

SUMMARY OF THE INVENTION

It is therefore an object of the invention to provide a display device which permits power dissipation in display elements and peripheral circuits to be reduced significantly in displaying a motion image or multiple windows and is equipped with a control circuit that permits display switching to be made at a high rate.

It is another object of the present invention to provide a display device which permits image quality to be much improved in displaying shades of gray using a plurality of display images.

It is still another object of the present invention to provide a pen-input display device which permits power dissipation to be reduced.

According to a first aspect of the invention there is provided a display device comprising: a substrate; a plurality of pixels arranged in rows and columns on the substrate; and a plurality of signal lines for providing image signals to the plurality of pixels on a column-by-column basis, each of the plurality pixels comprising: a plurality of memory elements for retaining the image signals sent over a corresponding one of the plurality of signal lines; selection means for selecting one of the plurality of memory elements; and a display element for displaying a dot at a brightness corresponding to contents of a selected one of the plurality of memory elements.

The display device further comprises a plurality of address lines for providing address signals to the plurality of pixels on a row-by-row basis, and the selection means may be arranged to select one of the plurality of memory elements when receiving an address signal from a corresponding one of the plurality of address lines and, at the same time, a signal from a corresponding one of the plurality of signal lines.

The display device further comprises a plurality of rewrite signal lines for providing rewrite signals to the plurality of pixels on a column-by-column basis, and each of the plurality of pixels further comprises rewrite direction means connected to receive a rewrite signal from a corresponding one of the plurality of rewrite signal lines, and the rewrite direction means may be arranged to direct the memory elements to rewrite their contents in response to the rewrite signals.

Alternatively, the display device further comprises: a plurality of address lines for providing row address signals to the plurality of pixels on a row-by-row basis; a plurality of column address lines for providing column address signals to the plurality of pixels on a column-by-column basis; a plurality of memory selection signal lines for providing selection signals for driving the selection means; and a memory selection controller for driving the plurality of memory selection signal lines, and the memory selection controller may be arranged to provide the selection signals for driving the selection means to the plurality of memory selection signal lines in synchronism with the row and column address signals.

In the display device, the selection means may be arranged to, when a first image signal for one pixel in a previous frame is stored in one of the plurality of memory elements and a second image signal for a pixel in a current frame corresponding to the one pixel in the previous frame is substantially the same as the first image signal, select the one of the plurality of memory elements which stores the first image signal and provides the first image signal to the display element.

In the display device, the first image signal may be a background image signal.

In the display device, an image signal stored in at least one of the plurality of memory elements may be an image signal for an image other than a multiwindow image currently displayed.

In the display device, at least one of the plurality of memory elements may be arranged to retain data processed in a background by a host system for providing the image signals.

In the display device, the plurality of memory elements of each of the plurality of pixels may be arranged to have a storage capacity large enough to retain an image corresponding to more pixels than the plurality of pixels arranged on the substrate, and such an image can be stored in the plurality of memory elements and displayed by being switched per substantially the number of the plurality of pixels on the substrate to the plurality of the image corresponding to more pixels than the plurality of pixels on the substrate.

In the display device, the plurality of memory elements in each of the plurality of pixels form a first memory circuit including at least one memory element and a second memory circuit including at least one memory element. When the first memory circuit stores an image signal for a right eye and the second memory circuit stores an image signal for a left eye, the selection means may be arranged to switch between the first and the second memory circuit at high speed to thereby provide a stereoscopic display.

According to the display device of the first aspect, each pixel has a plurality of memories and is supplied with an image signal, a memory select signal, and a rewrite direction signal, thus permitting the contents of a selected memory to be rewritten and the liquid crystal cell to be driven by an image signal retained.

In a motion-image display, it is an object image that moves mainly. In general, no or little change occurs in the background unless a change occurs in the scene or angle, or zooming is performed. In the case of multiwindow display as well, an image that is originally in the foreground is rewritten continually, but an image on the rear side will almost not be rewritten until it appears in the foreground.

In the present invention, a background image (or a window image on the rear side) and an object image (a window image on the front side) are retained in different memories for each pixel. Depending on whether a display image at each pixel is a background or an object, the memories are switched. Thereby, when an object image which was displayed at the pixel moves, the memory for background image in that pixel can be selected next. When an image signal which has been stored in the memory for background image can be utilized as it is, it can be utilized as it is. Thus, the prior art requirement of changing the memory contents from an object image to a background image is eliminated.

According to the present invention, therefore, if the pixel display contents are changed and an image signal stored in one of the memories can be used for the next image, it is necessary only that a select signal to select that memory be applied. Thus, even when an image change occurs, the number of times the liquid crystal panel is refreshed can be reduced significantly, resulting in power saving.

Moreover, image signal memories other than memories being used to apply image signals to the display elements can be updated by the results of execution in the background on the host system side. Thus, even when the application is changed from one to another on the host system side, the display image can be switched from one to another at high speed, shortening the image updating time.

Furthermore, the image signal memories other than the memories being used to apply image signals to the display elements can be used as a virtual screen, thus permitting image information which is larger in amount than an image that all the display elements can display to be stored. By fast switching between the image information for the virtual screen and the current image information, an image which equivalently has more pixels than there are pixels in the display panel can be displayed, thus implementing-a high-definition, low-power-dissipation display device.

According to a second aspect of the invention, there is a display device comprising: a substrate; a plurality of pixels arranged in rows and columns on the substrate; a plurality of address lines arranged in rows; a plurality of signal lines arranged in columns; and a plurality of row control lines arranged in rows, each of the plurality of pixels including: a display element having a pixel electrode; a first switch having a first conduction path, one end of the first conduction path being connected to the pixel electrode of the display element, and conduction of the first conduction path being controlled by a corresponding one of the plurality of control lines; a memory circuit having an input terminal and an output terminal, the output terminal being connected to the other end of the first conduction path and the memory circuit including at least one memory element; and a second switch having a second conduction path, one end of the second conduction path being connected to the input terminal of the memory circuit and the other end of the second conduction path being connected to a corresponding one of the plurality of signal lines, and conduction of the second conduction path being controlled by a corresponding one of the plurality of row address lines.

The display device may further comprises a plurality of column control lines arranged in columns, and each of the plurality of pixels may further include a third switch having a third conduction path connected between the input terminal of the memory circuit and the one end of the second conduction path, conduction of the third conduction path being controlled by a corresponding one of the plurality of column control lines.

Alternatively, the display device may further comprises a plurality of column control lines arranged in columns, and each of the plurality of pixels may further includes a third switch having a third conduction path connected between the output terminal of the memory circuit and the other end of the first conduction path, conduction of the third conduction path being controlled by a corresponding one of the plurality of column control lines.

The memory circuit may include at least two memory elements, a first synchronizing signal input terminal connected to receive a first synchronizing signal for switching between the memory elements at the time of data entry, and a second synchronizing signal input terminal connected to receive a second signal synchronizing signal to switch between the memory elements at the time of data output.

Each of the memory elements may store a color signal, and the second synchronizing signal may be changed at regular intervals to thereby cause the display element to display a shade of gray.

The memory circuit in each of the plurality of pixels may have a data transfer line connected to a memory circuit of one of neighboring pixels, thereby allowing data retained in the memory circuit to be transferred to the memory circuit of one of the neighboring pixels.

The data may be color information.

Further, the display device may be arranged to comprise: a substrate; a plurality of pixels arranged in rows and columns on the substrate; a plurality of first signal lines arranged in columns; a plurality of second signal lines arranged in columns, each of the plurality of second signal lines being paired with a respective one of the plurality of first signal lines; a plurality of first control lines arranged in columns; and a plurality of second control lines arranged in columns, each of the plurality of second control being paired with a respective one of the plurality of first control lines, each of the plurality of pixels including: a display element having a pixel electrode; a first switch having a first conduction path, one end of the first conduction path being connected to the pixel electrode of the display element, conduction of the first conduction path being controlled by a corresponding one of the plurality of first control lines; a memory circuit having an input terminal and an output terminal, the output terminal being connected to the other end of the first conduction path and the memory circuit including at least one memory element; and a second switch having a second conduction path, one end of the second conduction path being connected to the pixel electrode of the display element and the other end of the second conduction path being connected to a corresponding one of the plurality of second signal lines, conduction of the second conduction path being controlled by a corresponding one of the plurality of second control lines.

According to the second aspect of the present invention, image signals can be written into individual pixels arranged in rows and columns or plural pixels from their respective memory circuits. That is, each pixel can be written into arbitrarily. The time interval at which a rewrite operation is performed can be varied for each pixel or each pixel block and image signals are supplied from the memory circuits. Thus, display can be made without operating the signal driver or its associated drivers that dissipate high power, resulting in a significant reduction in power dissipation.

For example, the use of a liquid crystal material having short holding times will require the refresh rate to be increased by changing control signals. In this case, since image signals have been recorded into the memory elements, no writing into the memory elements is required. In addition, by turning OFF control signals for pixels which do not need writing and selectively inputting image signals into memory circuits, the writing into the pixels and the recording into the memory circuits can be performed independently. This allows a motion image which requires to be rewritten at high rate to be displayed with little residual image.

According to the second aspect of the present invention, even with a display image which will cause flicker of a switch frequency of 30 Hz when display colors A and B are switched in a specific pattern, the switch frequency can be elevated to, for example, 120 Hz at which flicker cannot be recognized by recording the display colors A and B into memory circuits and changing control signals.

Moreover, in liquid crystal cells in which, even if the same image signal is applied, their brightness differs with the polarity of signal writing, flicker-free display can be made by switching between the display color A written with the plus polarity and the display color B written with the minus polarity at a high frequency.

Furthermore, although an erroneous display may be made in a specific pattern because the display colors A and B are displayed at predetermined locations, the display colors can be transferred between adjacent memory elements to avoid the visual recognition of the erroneous display.

In addition, in scrolling a display image left, right, up, or down, image information in each memory element can be transferred to its adjacent pixel as it is to shift the display image. That is, the display image can be shifted without operating the signal driver or its associated drivers, resulting a significant reduction in power dissipation.

Further, when, in a motion image in which a moving object is present on a background image, the background image is scrolled up, down, left, or right and the moving image moves independently, it is required that an image signal for the moving object be mainly transferred. For the background image, the image signal can be supplied by transfer between memory elements. Thus, power dissipation can be reduced significantly and the rewrite frequency for the moving object can be elevated, thus allowing more realistic display.

Furthermore, according to the present invention, the switching between window images and the initial screen display at startup of a computer can be made in a short time. In addition, it is also possible to have a resume function of recording the display screen contents when the computer is turned OFF. To preserve the liquid crystal panel characteristics, a display image with the screen saving effect can be recorded into the memory elements to refresh the screen at regular intervals.

According to a third aspect of the present invention, there is provided a display device comprising: a substrate; a plurality of pixels arranged in rows and columns on the substrate; a plurality of signal lines for providing an image signal to the plurality of pixels on a column-by-column basis; a signal line driver for driving the plurality of signal lines; first storage means for retaining an externally input image signal as a first record signal; and a subtracter for producing a difference signal between the image signal at one point of time and the first record signal prior to the point of time which is retained in the first storage means and outputting the difference signal to the signal line driver, the signal line driver outputting the difference signal as the image signal, and each of the plurality of pixels including: second storage means for storing a second record signal corresponding to the first record signal stored in the first storage means; an adder for adding the second record signal stored in the second storage means and the difference signal; and a display element for displaying a dot at a brightness corresponding to an output of the adder.

It is preferable that the first storage means include a plurality of first memory elements and a first selector for selecting one of the plurality of first memory elements, and the second storage means include a plurality of plurality of second memory elements and a second selector for selecting one of the plurality of second memory elements.

The display device preferably further comprises a select signal driver for driving the second selector on a basis of a result of selection by the first selector.

With the display device of the third aspect, it is required to transfer only the difference from the most correlated image. Thus, a further reduction in power dissipation can be made.

According to a fourth aspect of the invention, there is provided a display device comprising: a substrate; a plurality of pixels arranged in rows and columns on the substrate; a plurality of address lines arranged in rows; a plurality of signal lines arranged in columns; a plurality of row scanning lines arranged in rows; a plurality of column scanning lines arranged in columns; a vertical scanner for driving each of the plurality of row scanning lines in sequence; a horizontal scanner for driving each of the plurality of column scanning lines in sequence; and operation means for performing operations on position data obtained through the vertical scanner and the horizontal scanner to obtain coordinate data at a pixel location that is specified by an external light signal, each of the plurality of pixels comprising: a first memory circuit selected by a corresponding one of the plurality of address lines for storing an image signal sent over a corresponding one of the plurality of signal lines; a photoelectric conversion element for sensing presence or absence of the external light signal to produce a detect signal in the presence of the external light signal; a second memory circuit selected by a corresponding one of the plurality of row scanning lines for storing the detect signal from the photoelectric conversion element and outputting the detect signal onto a corresponding one of the plurality of column scanning lines; an OR circuit for taking the logical sum of the image signal retained in the first memory circuit and the detect signal retained in the second memory circuit to output a logical sum signal; and a display element for displaying a dot at a brightness corresponding to the logical sum signal from the OR circuit.

The first memory circuit can include a plurality of memory elements.

The display device preferably further comprises a digital-to-analog converter connected between the OR circuit and the display element.

The display device has a photosensor and a plurality of memory circuits for each pixel, the photosensor detecting the coordinate data of a light pen. The coordinate data is stored in one of the memory circuits. Thus, it is not required to read the coordinate data fast and a reduction in power dissipation of the read driver and the data transfer circuit can be achieved.

An image signal is retained in one of the memories, and a voltage corresponding to the logical sum of the coordinate data and the image signal is applied to the display element, allowing the coordinate position to be displayed instantly although the speed at which the coordinate data is read is slow.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Before describing the embodiments of the present invention, the power dissipation of a liquid-crystal display device will be described.

Figure 1:
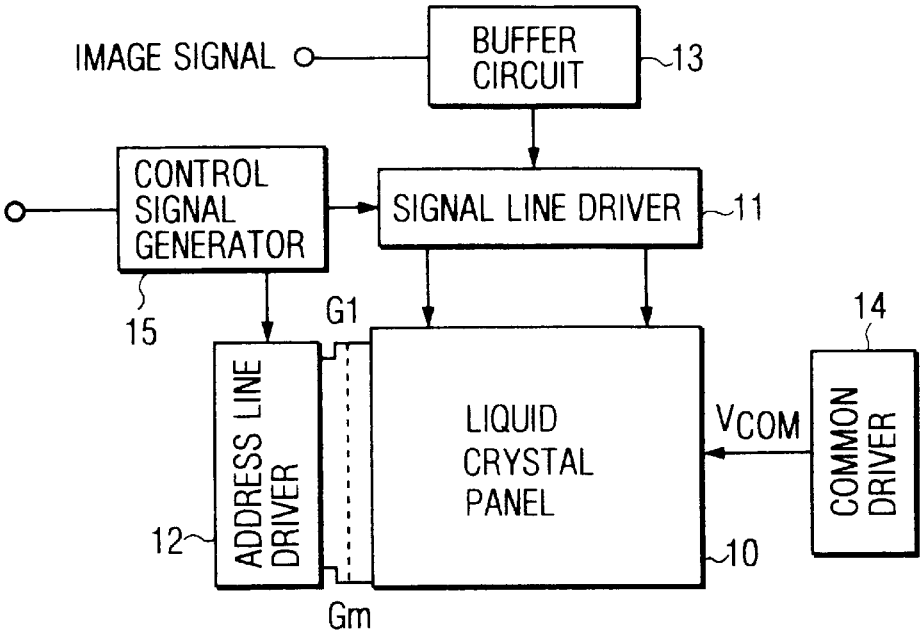
F I G. 1 A PRIOR ART
FIG. 1A is a schematic illustration of a conventional liquid-crystal display device.
FIG. 1B is a schematic illustration of the display panel of FIG. 1A.
Figure 1:
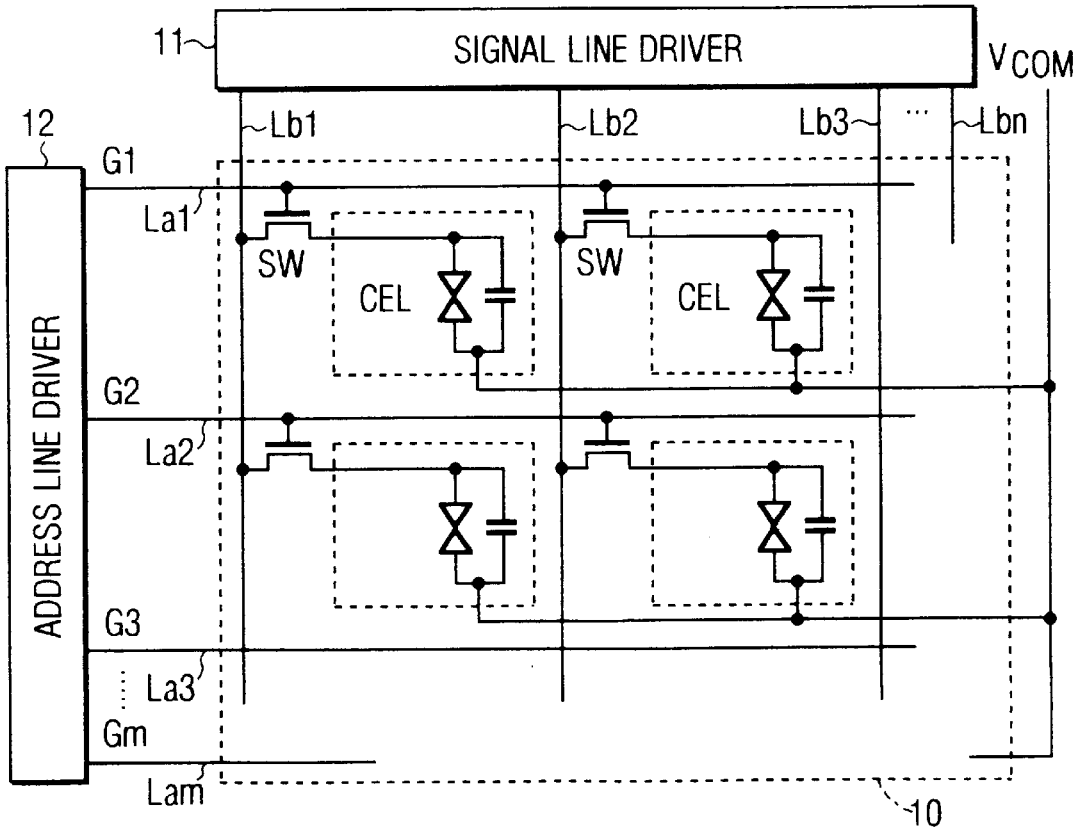
F I G. 1 B PRIOR ART

As illustrated in FIG. 1A, a general liquid-crystal display device comprises a liquid-crystal display panel 10, a signal line driver 11, an address line driver 12, a buffer circuit 13, a common driver 14, and a control signal generator 15.

As illustrated in FIG. 1B, the liquid-crystal display panel 10 comprises an array of small liquid-crystal display cells CEL which are arranged in rows and columns. The cells arranged in the same row are connected to a corresponding one of row scanning lines L*a*1 to L*a*m. The cells arranged in the same column are connected to a corresponding one of pixel signal lines L*b*1 to L*b*n corresponding to the columns. Each cell CEL is supplied with an image signal from the corresponding image signal line by its associated switch SW being turned ON or driven by the corresponding row scanning line. Consequently, across the cell CEL is supplied a voltage corresponding to the difference between an applied potential from the corresponding pixel signal line and the potential of a common power supply VCOM, so that its brightness is varied accordingly.

The common power supply VCOM provides the common potential to each of the liquid crystal cells, which is generated by the common driver 14 shown in FIG. 1A. The control signal generator 15 provides various control signals required for display operations to various sections of the display device.

The switches SW associated with the respective cells CEL are each formed of a thin-film transistor (TFT), which has its gate connected to a corresponding one of the row scanning lines L*a*1 to L*a*n and is turned ON and OFF by a signal on the corresponding row scanning line.

Each switch SW has its source—drain path connected between the corresponding signal line and the corresponding liquid crystal cell and, when driven ON by the corresponding row scanning line with which its gate is connected, provides a corresponding output of the signal line driver 11 to the corresponding cell CEL.

The address line driver 12 provides each of drive signals G1 to Gm to a corresponding one of the row scanning lines L*a*1 to L*a*m in time sequence so that the switches SW associated with the respective cells CEL are driven on a row-by-row basis. In this way, each row is scanned in time sequence.

On the other hand, upon receipt of image signals corresponding to pixels via the buffer circuit 13, the signal line driver 11 controls the state of each of pixels on a row being scanned in accordance with the image signals. That is, the image signals for the pixels on a row being scanned are output onto the pixel signal lines LB1 to L*b*n in time sequence so that each of the image signals will be output to a corresponding one of the cells on the row being scanned.

Thus, in the liquid crystal panel as shown in FIG. 1B, a pixel display is made by outputting an ON pulse onto a row scanning line to turn ON the switches associated with the liquid crystal cells on the row being scanned and by applying an image signal from the signal line driver 11 to a pixel on the row being scanned to apply a voltage between the common voltage and the image signal to the liquid crystal cell CEL corresponding to that pixel.

Here, a study will be made of what factors the power dissipation of the driver circuitry of the liquid crystal display device depends on. In this case, it is supposed that the power dissipation due to direct bias currents is not involved.

As described above, the driver circuitry of the liquid crystal display device is basically divided into the signal line driver, the buffer circuit, the control signal generator, the common driver, and the address line driver. Hereinafter, each of these drivers will be described in detail.

1) The Signal Line Driver

There are two types of signal line drivers: digital, and analog. Since computers handle digital images, the power dissipation will be examined for a digital type of signal line driver which well matches computers.

Basically, a digital type of driver IC comprises a shift register that determines the signal sampling time, a latch circuit that latches a digital signal, a D/A converter which converts a digital signal to an analog signal, and an output buffer that drives signal lines. In this case, since the power dissipation depends on the latch circuit and the output buffer, it will be sufficient to consider only the two circuits.

The maximum power dissipation P1 of the latch circuit is given by $$P1=(C1+2Cck)\times fs/2\times V_1^2 \quad (1)$$

where C1 is the equivalent input capacitance of the circuit for image signals, Cck is the equivalent input capacitance for sampling clocks, fs is the image sampling frequency, and $V_1$ is the supply voltage for the latch circuit.

The maximum power dissipation Pob of the output buffer is given by $$Pob=Nh\times Css\times fh\times Vs^2/2 \quad (2)$$

where Css is the signal line capacitance, fh is the horizontal drive frequency, Nh is the number of pixels along horizontal lines, and Vs is the signal line voltage.

2) The Buffer Circuit

The buffer circuit is adapted to remove noise from and waveshape an input digital signal for the purpose of providing stable digital signals to the signal line driver. Depending on circumstances, the buffer circuit may be omitted, but basically it is needed. The maximum power dissipation Pb of the buffer circuit is given by $$Pb=(2Cbc+Cbp)\times fs\times 2\times Vb^2 \quad (3)$$

where Cbc is the equivalent input capacitance of the buffer circuit for a sampling clock, Cbp is the equivalent input capacitance for image signals, fs is the sampling clock frequency, and Vb is the supply voltage for the buffer circuit.

3) Control Signal Generator

The control signal generator basically comprises a gate array and its internal frequencies differ with signals. The power dissipation related to the image sampling clock fs is chiefly considered to be an important factor. The maximum power dissipation of the entire gate array is given by $$Pga=(2Cgac+Cgap)\times fs/2\times Vga^2 \quad (4)$$

where Cgac is the equivalent internal capacitance for a sampling clock, Cgap is the equivalent input capacitance of the circuit for image signals, fs is the sampling clock frequency, and Vga is the supply voltage of the gate array.

4) Common Driver

The common driver is adapted to drive the common capacitance Cc. The maximum power dissipation of the common driver is given by $$Pc=Cc\times fc\times Vc^2 \quad (5)$$

where fc is the common capacitance driving frequency, and Vc is the supply voltage of the common driver. Note that with common inversion, fc is half the horizontal drive frequency fh.

5) Address Line Driver

The address line driver is adapted to drive the capacitance Cg of address lines (gate lines). The maximum power dissipation Pg of the address line driver is given by $$Pg=Cg\times fh\times Vg^2 \quad (6)$$

where fg is the address line driving frequency and Vg is the supply voltage for the address line driver. The address line drive frequency fg is normally the horizontal drive frequency fh.

6) Power Dissipation of the Entire Circuit

Thus, the power dissipation Pall of the entire circuit becomes $$\begin{aligned} Pall &= P1 + Pob + Pb + Pga + Pc + Pg \\ &= (C1 + 2Cck)\times fs/2\times V_1{}^2 + Nh\times Cs\times fh\times Vs^2/2 + \\ &\quad (2Cbc + Cbp)\times fs/2\times Vb^2 + (2Cgac + Cgap)\times fs/2\times Vga^2 + \\ &\quad Cc\times fc\times Vc^2 + Cg\times fh\times Vg^2 \end{aligned}$$

In this case, assuming that Nh×Css>>Cg, $$\begin{aligned} Pall &= (C_1 + 2Cck + 2Cbc + Cbp + 2Cgac + Cgap)\times(fs/2)\times \\ &\quad V^2 + Nh\times Css\times(fh/2)\times V^2 \\ &= Pall(C, f, V) \end{aligned} \quad (7)$$

Thus, Pall becomes a function of the capacitance C, the driving frequencies f (the horizontal drive frequency and the image clock frequency), and the supply voltage V of the digital circuits.

In this case, the capacitance C depends on the device structure, and the voltage V depends on the IC manufacturing process and the liquid crystal panel structure such as the V-T characteristic of liquid crystal. However, the frequency f is determined by the system and the image quality such as the image horizontal scanning frequency and flicker characteristic, but it can be lowered, depending on the way the liquid crystal device is driven.

Next, a study will be made of what factors the power dissipation of the liquid crystal panel depends on. As shown in FIGS. 1A and 1B, the liquid crystal panel is supplied with pixel image signals and scanning signals over the pixel signal lines and the row scanning lines (address lines), so that corresponding pixels are displayed. At this point, to drive the pixel signal line capacitance Csig and the row scanning line capacitance Cg, the amounts of power of $Csig\times f\times V^2$ and $Cg\times f\times V^2$ are dissipated, respectively. The power thus dissipated is not available in the image display of the liquid crystal display device and hence becomes a loss.

In order to reduce the power loss, it is required to reduce the capacitance C, the frequency f, and the voltage V. With a still image, the frequency f could be lowered to zero. With a moving image, however, the frequency f cannot be made zero. With a complex image, the display level of each pixel CEL will vary at short intervals, which will result in an increase in driving power as well.

The above-described memory-equipped LCD device writes an image signal obtained via a switch into a pixel memory and displays a pixel using the memory contents. When adapted to display a still image, the LCD device has an advantage of reducing the driving frequency f and the static power consumption. In order to display a motion image, however, it is naturally required to elevate the driving frequency f. An increase in the driving frequency will result in an increase in the overall power consumption.

That is, with the conventional memory-equipped liquid crystal display device arranged to store a display image signal for each pixel, it can be expected that, when it is used for still image display, the driving frequency f and the static power consumption will be reduced. When it is used for motion image display, however, such an advantage of reducing the power consumption cannot be expected at all.

For this reason, the invention provides a liquid crystal display device that permits power consumption to be reduced in motion image display and multi-window display as well and display images to be switched at high speed. Hereinafter, the embodiments of the present invention will be described specifically.

First Embodiment

Figure 2A:
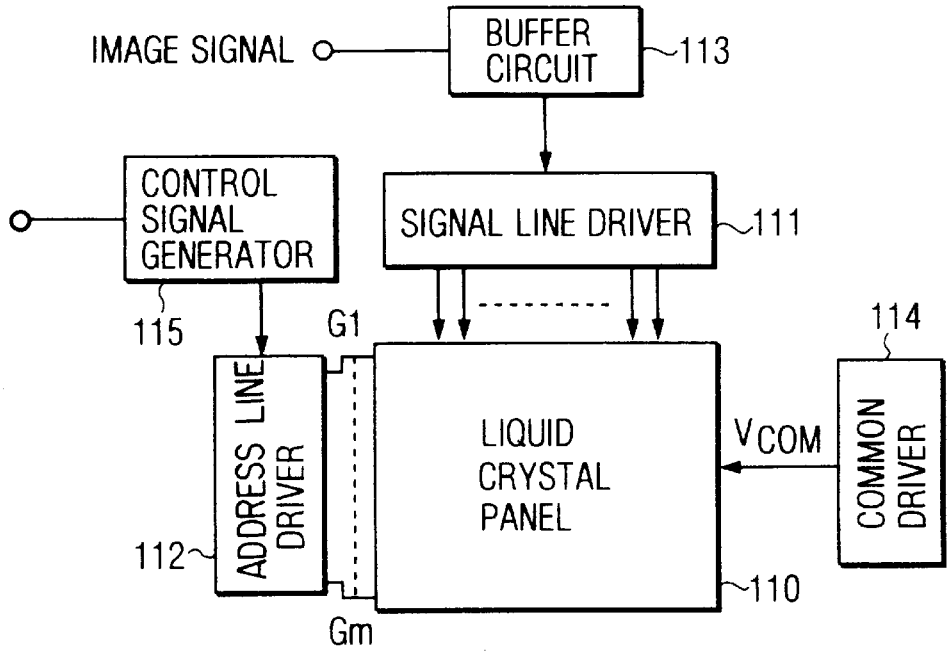
FIG. 2A is a schematic illustration of a liquid-crystal display device according to a first embodiment of the present invention.
Figure 2B:
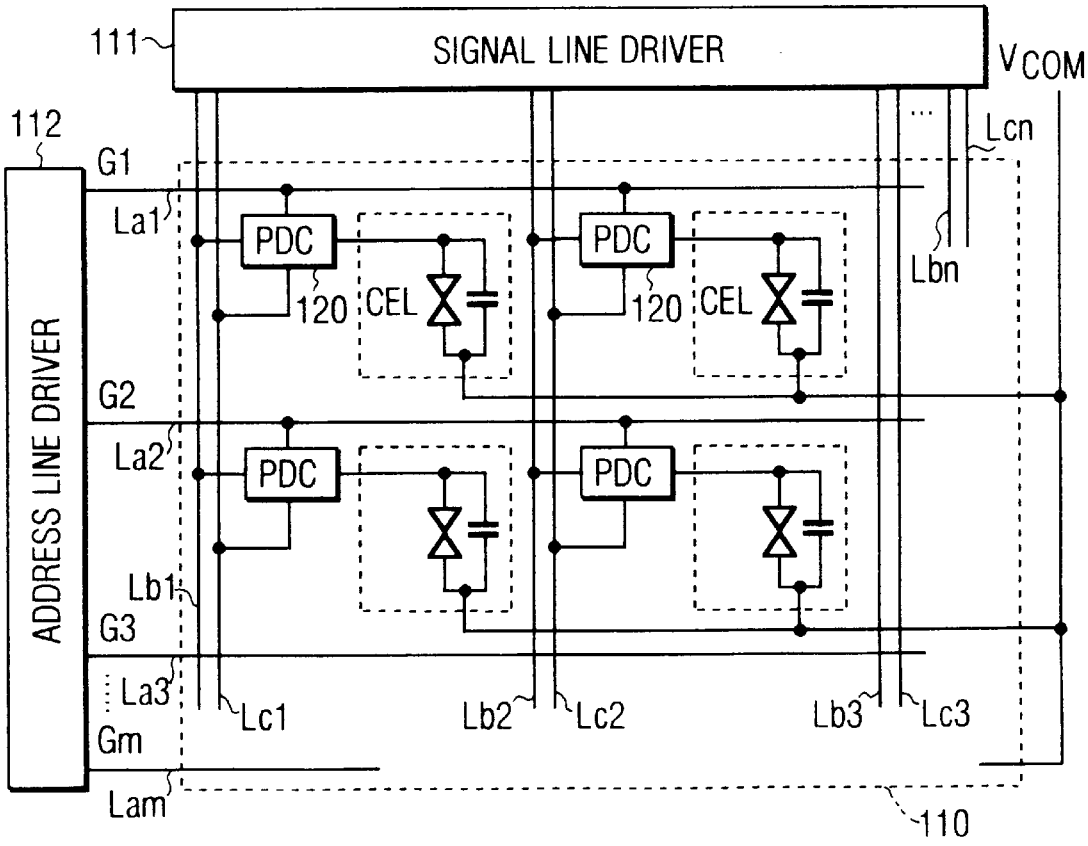
FIG. 2B is a schematic illustration of the display panel of FIG. 2A.
Figure 3:
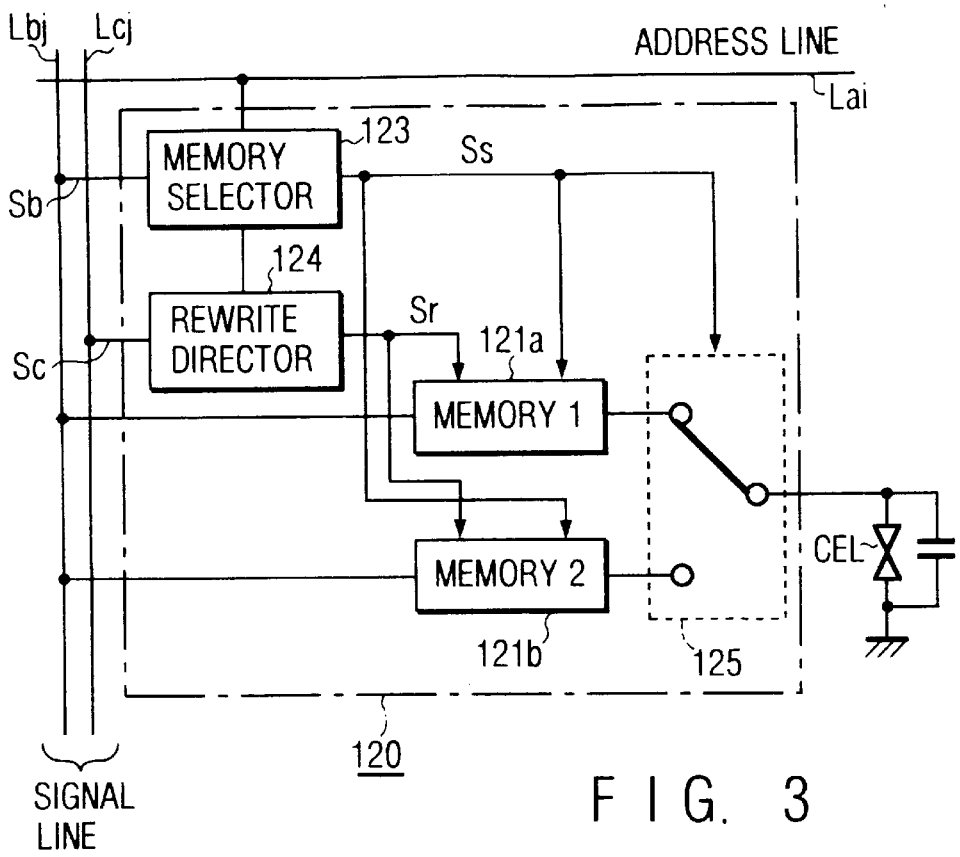
FIG. 3 is a schematic illustration of a pixel display control circuit in the first embodiment of the present invention.
Figure 4A:
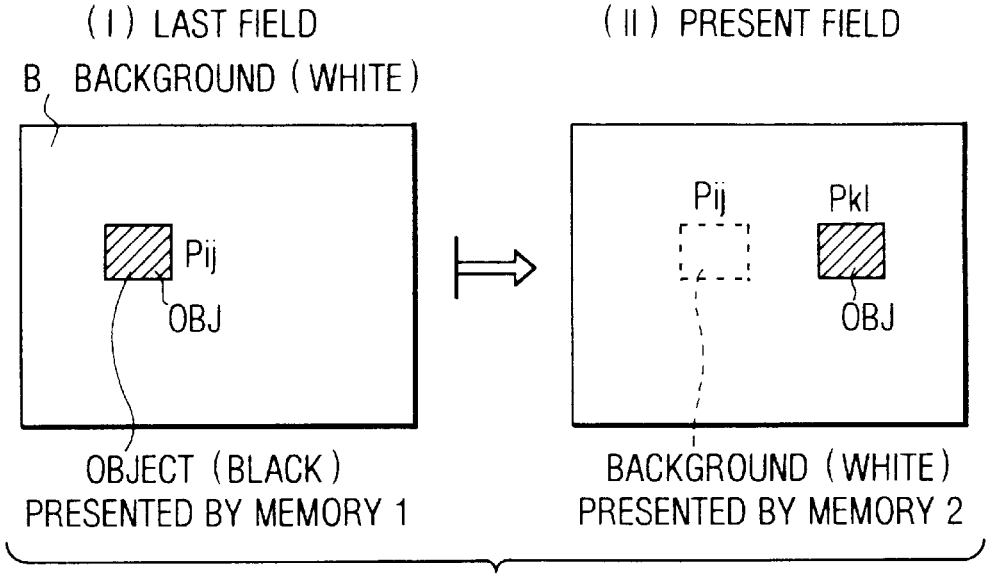
FIG. 4A is a diagram explanatory of the operation of the first embodiment illustrating a change in a display image.
Figure 4B:
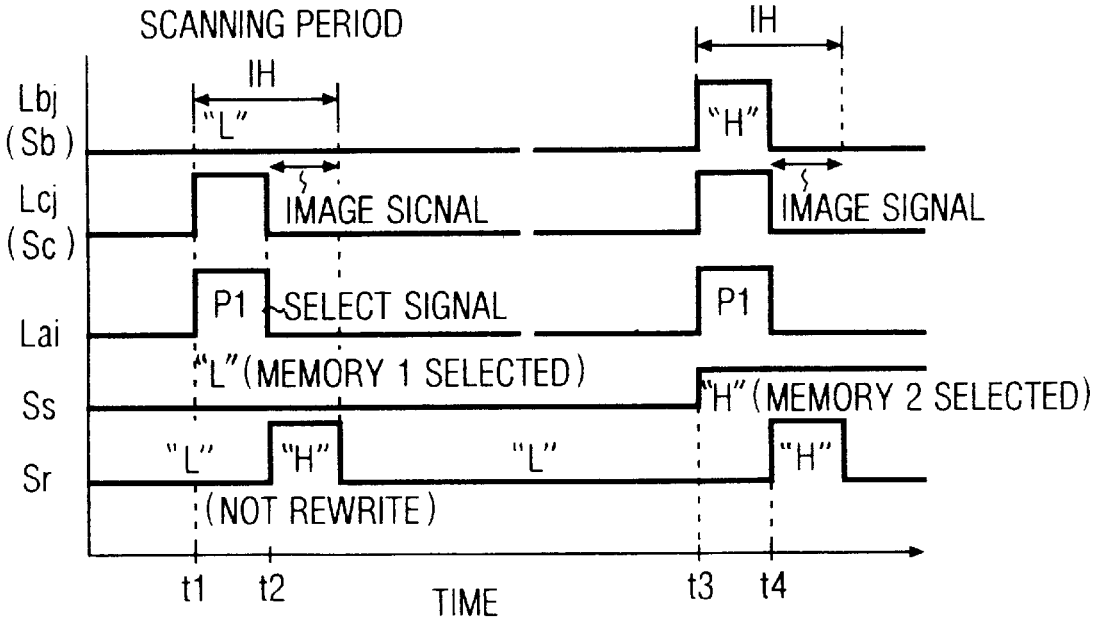
FIG. 4B is a timing diagram explanatory of the operation of the first embodiment.

FIGS. 2A and 2B are schematic illustrations of a liquid crystal display device according to a first embodiment of the invention, FIG. 3 is a more-detailed illustration of one pixel element of the arrangement of FIG. 2B, and FIGS. 4A and 4B are diagrams explanatory of the operation of the arrangement of FIG. 3.

In FIGS. 2A and 2B, reference numeral 110 denotes a liquid crystal panel 110, 111 denotes a signal line driver, 112 denotes an address line driver, L*a*1 to L*a*m denote row scanning lines, L*b*1 to L*b*n denote image signal lines, and L*c*1 to L*c*n denote rewrite control signal lines that constitute the feature of the present embodiment.

The signal line driver 111 first generates a memory select signal for each of pixels and outputs it onto a corresponding one of the image signal lines L*b*1 to L*b*n, the signal making a selection between memories depending on whether the corresponding pixel is to display a background image or an object image. At the same time the memory select signals are generated, the signal line driver generates a rewrite direction signal for each of pixels and outputs it onto a corresponding one of the rewrite control signal lines L*c*1 to L*c*n, the rewrite direction signal indicating an image to be displayed by the corresponding pixel requires to be rewritten. The signal line driver then outputs an image signal for each pixel onto a corresponding one of the image signal lines L*b*1 to L*b*n.

Information as to which pixels are to display a background image or an object image and which pixels are to be rewritten is prepared for each pixel on the host computer side and sent to the signal line driver 111 along with image signals. Upon receipt of such information and the image signals, the signal line driver 111 first outputs a rewrite direction signal and a memory select signal for each pixel and then outputs an image signal for each pixel.

The address line driver 112 generates address line (gate line) drive signals G1 to Gm in sequence with the time required to scan all the row scanning lines L*a*1 to L*a*m as a period. In arrangement, the address line driver basically remains unchanged from the conventional one. The signal line driver 111 operates in synchronism with the address line driver 112.

As shown in FIG. 2B, the liquid crystal panel 110 is composed of small liquid crystal display cells CEL arranged in rows and columns, row scanning lines L*a*1 to L*a*m for driving the display cells for a row-by-row basis, and pixel signal lines L*b*1 to L*b*n for applying pixel signals to the display cells on a column-by-column basis. Each liquid crystal display cell CEL is selectively driven by its respective corresponding row scanning line and pixel signal line.

The rewrite control signal lines LC1 to L*c*n are each paired with a respective one of the pixel signal lines L*b*1 to L*b*n to allow each pixel to receive a corresponding rewrite control signal.

Figure 5:
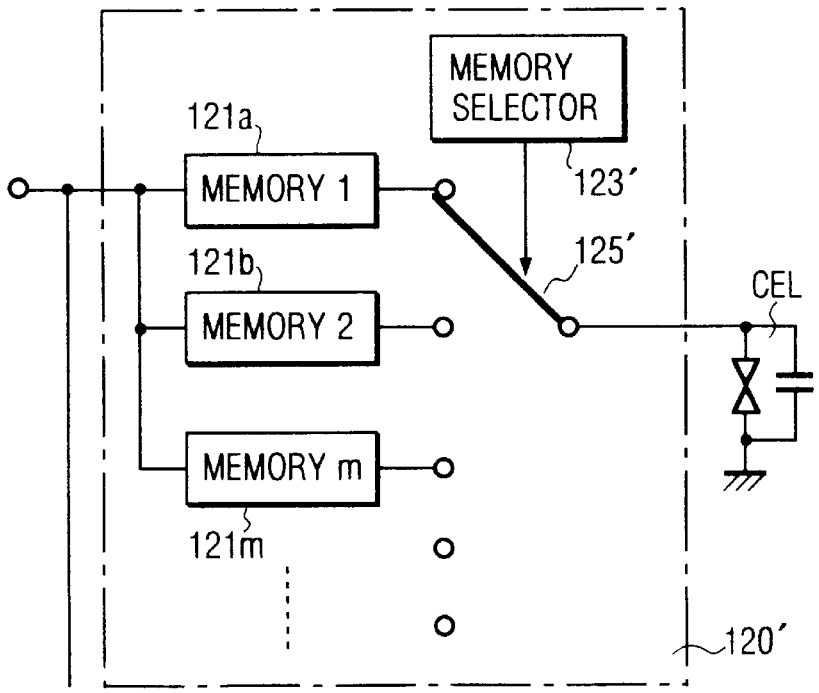
FIG. 5 illustrates a modification of the pixel display control circuit of the first embodiment.

Each liquid crystal display cell CEL is equipped with a pixel display controller (PDC) 120, which, as shown in FIG. 3, includes a plurality of memories for storing image signals (pixel display data). In this example, there are illustrated a two-memory configuration: a first memory 121*a* for object image, and a second memory 121*b* for background image. This is for convenience of description only. As shown in FIG. 5, three or more memories can be used.

The PDC 120 further includes a memory selector 123, a rewrite director 124, and a memory switch circuit 125.

The first and second memories 121*a* and 121*b* of each cell (pixel) receive an image signal over one of the image signal lines L*b*1 to L*b*n that corresponds to the column for that cell and hold it. The rewrite control of the memories is performed by the rewrite director 124.

The memory selector 123 of each pixel receives a gate drive signal over a corresponding one of the row scanning lines L*a*1 to L*a*m to take a signal S*b* from the corresponding one of the image signal lines L*b*1 to L*b*n during the first time interval, thereby providing to the first and second memories 121*a* and 121*b* and the memory switch circuit 125 a signal S*s* indicating which of the first and second memories is to be selected.

In this example, when the signal S*s* is at logic level L (0), it indicates that the first memory 121*a* is to be selected, while, when the signal S*s* is at logic level H (1), it indicates that the second memory 121*b* is to be selected. When the signal S*r* is at logic level L, it indicates the selected memory is to be rewritten, while, when the signal S*r* is at logic level H, it indicates that the selected memory is not to be rewritten.

The memory switch circuit 125 of the pixel display controller 120 is responsive to the signal S*s* to make a selection between the outputs of the first and second memories 121*a* and 121*b*. When the signal S*s* is at logic level L, the output of the first memory 121*a* is selected. When the signal S*s* is at logic level H, on the other hand, the second memory 121*b* is selected. The liquid crystal cell CEL makes a pixel display according to the output of the first or second memory obtained through the memory switch circuit 125. The cell CEL is impressed with a voltage corresponding to the difference between an applied potential from the corresponding signal line and the potential of the common power supply VCOM, thereby changing the pixel display level according to the voltage.

In the present system, each pixel is equipped with two memories as shown in FIG. 3. Each of these memories is adapted to store either of image data corresponding to one pixel of a background image and image data corresponding to one pixel of an object image. Either one of the memories is selected by an externally applied memory select signal, so that the contents of the selected memory are used as the display contents of the pixel.

The memory select signal is applied from the signal line driver 111 to each liquid crystal cell along with a rewrite direction signal prior to application of image data to each cell. After that, image data is applied to the selected memory for each pixel.

When a change occurs in a display image, image data of the changing image are written into selected memories and then used to drive the cells in order to reflect the change. In the absence of any change in a display image, on the other hand, no writing into the memories is performed. The image data which have been already stored are read from the memories to drive the cells CEL.

In the presence of a change in at least one portion of the next image, the prior art rewrites the contents of the memories of each cell by externally applied image data of that image (for a full screen). Each cell is driven by the updated memory contents. In the present invention, if there is a memory which, of the memories that each cell has, stores a signal close to an image signal to be displayed next, that memory is selected. That is, even if a change occurs in a portion of an image, all the pixel memories need not be updated and only pixel memories corresponding to that image portion are required to be updated.

Thus, as with a moving image, in an image which is partly subject to change, previously stored image data are used as they are for pixels corresponding to the unchanged portion of the image, permitting useless rewriting of the memory contents of each pixel to be avoided. As a result, in the display of a moving image as well, many pixels will not need rewriting that involves high power dissipation, which helps reduce the power dissipation of the liquid crystal display device.

Next, the operation of the present embodiment will be described in more detail taking a specific example.

Suppose here that each pixel has a pair of memories 121*a* and 121*b* as shown in FIG. 3, and the second memory 121*b* stores background image information.

First, a description will be given of the case where, as shown in FIG. 4A, an image in which its background B is white makes a change such that a black point OBJ corresponding to one pixel moves right from location P*ij* to location P*kl*.

As described previously, the liquid crystal panel has the row scanning lines L*a*1 to L*a*m, the first signal lines L*b*1 to L*b*n used to send memory select signals and image signals, and the second signal lines L*c*1 to L*c*n used to send rewrite control signals.

FIG. 4B is a timing diagram of signals in the liquid crystal cell. In this case, at time t1, the pixel at location P*ij* displays black. In this example, since a black point of one pixel moves through a white background, the background remains black until the end. Thus, of the two memories 121*a* and 121*b* of each cell, the second memory 121*b* for background information need not be rewritten into after it stored white background image data in the beginning.

Image data for the black point, the moving object image, is written into the first memory 121*a* for object image of the cell at the display location in the current field and then displayed. On the other hand, the first memory of the cell at the location where a black point was displayed in the previous field had already been written with black image data. In the prior art, in order to allow a change from object image to background image, it is required to rewrite the contents of the memory which has been written with black data by white data.

With the present invention, to save the need of rewriting memory contents for return to background image, each cell is equipped with two memories: one for object image, and the other for background image. The two memories are used properly.

In the example of FIG. 4A, the pixel at the location P*ij* on the screen shown in (I) continues the state of black display in the previous field. In the next field (II), the black point moves to the location P*kl* and the pixel at the location P*ij* is changed from black to white. The signal sequence will be described with reference to FIG. 4B. Let the row scanning line and the first and second signal lines corresponding to the pixel at the location P*ij* be L*ai*, L*bj*, and L*cj*, respectively.

If the pixel at the location P*ij* has already experienced a display of background image before a black point is displayed at that location, then the second memory 121*b* of the cell at that location will have stored background image data. When a black point is displayed at the location P*ij* as shown in FIG. 4A(I), black image data is written into the first memory 121*a* at that location.

Assume that a black point is still displayed at the location P*ij* at time t1 and a transition is then made to the state of FIG. 4B(II). Then, at time t1, the contents of the first memory 121*a* are displayed and, at time t2, switching is made from the first memory to the second memory 121*b* to display the background image at the location P*ij*.

This sequence will be described in accordance with FIG. 4B. In the first place, a gate drive signal is output onto the row scanning line L*ai* as a select pulse P1 at time t1. In synchronism with the pulse P1, a select signal S*b* indicating which of the first and second memories to select is output onto the first signal line L*bj* during the first half of one horizontal scanning period (1H period). A memory rewrite control signal S*c* indicating where the selected memory is to be rewritten into or not is output onto the signal line L*cj* during the second half of the 1H period beginning at t2. An image signal corresponding to this horizontal scanning location is output onto the first signal line L*bj* during the second half of the 1H period.

The present invention uses a signal supply system such that a memory select signal is first output onto the signal line L*bj* and then image data is output onto the signal line L*bj*. At time t1, the pixel at the location P*ij* keeps displaying black as in the previous field. Thus, in order to select the first memory for object image, the memory select circuit 123 outputs a select signal S*s* at logic level L. In order not to rewrite the memory contents, the rewrite director 124 outputs a signal S*r* at logic level H indicating "rewrite inhibit". Image data for that pixel is output onto the signal line L*bj* during the second half of the 1H period.

Although the image data is applied to the first memory 121*a*, its contents remain unchanged because the signal S*r* is at logic level H indicating "rewrite inhibit".

The select signal S*s* at logic level L is also applied to the memory switch circuit 125, which therefore selects the output of the first memory 121*a*.

By these operations, the previously stored contents of the first memory 121*a* are applied through the memory switch circuit 125 to the liquid crystal cell, which displays the object image at a gradation corresponding to the contents of the first memory.

Next, at time t3, a row scanning gate drive pulse P1 is output again onto the scanning line L*ai*. At the same time, a memory select signal S*b* is output onto the first signal line L*bj* during the first half of the 1H period. During the second half of the 1H period beginning at t4, a rewrite signal S*r* by which whether the memory contents are to be rewritten or not is determined is output onto the signal line L*cj* and image data is output onto the first signal line L*bj*.

At time t3, the black point has moved from the location P*ij* to the location P*kl*. Therefore, the background must be displayed at the location P*ij* and hence white is displayed at P*ij*. The memory select signal S*s* thus goes to the H level selecting the second memory 121*b* storing background image data. This signal is also applied to the memory switch circuit 125 to thereby permit the output of the second memory 121*b* to be selected.

As a result, the second memory 121*b* is selected, so that white background image data is applied to the cell at the location P*ij* and hence white is displayed at that location.

At this point, in order not to rewrite the memory contents, the rewrite director 124 outputs onto the signal L*cj* a signal S*r* at logic level H. Although image data for the cell at the location P*ij* is output onto the signal line L*bj* and applied to the first memory 121*a* during the second half of the 1H period, the contents of the first memory remain unchanged because the signal S*r* is at logic level H.

That is, image data used for the cell to display white is the past image data which has been stored in the second memory. Therefore, since the need of rewriting the contents of the second memory is eliminated, it becomes unnecessary to dissipate power for rewriting.

To rewrite the memory contents, the signal S*r* is made low. As a result, image data that is being output onto the first signal line L*bj* is written into one of the first and second memories that is being selected at that time. In this case, the image data that has been written into the selected memory will be displayed.

As described above, according to the first embodiment of the present invention, by storing background information for each pixel, the need of transferring background information again is saved in such a case where a moving object is displayed in front of a background and, after once disappeared, the background appears again. That is, the background can be displayed again simply by switching between the memories. As a result, power dissipation can be reduced significantly.

In the case of moving images in particular, some backgrounds will move as in natural images. However, in the case of a room or a distant background, it is usual that no or little change occurs in the background unless the scene or camera angle is changed or zooming is performed. It is an object, i.e., a central subject such as a person, that makes changes. As long as a moving object is moved according to an image signal, even if some change occurs in the background and the change is not reflected in the display, a serious problem will not arise.

Therefore, the method of the present invention of storing background image information for each pixel and utilizing the stored background information to display the background again after the movement of an object image is effective in reducing power dissipation in moving image display. A liquid crystal display device adapted for moving image display can therefore be expected to have an advantage of reducing power dissipation significantly.

Where text or a moving image is displayed in the multi-window form, the display can be switched instantaneously from a visible window to an invisible window by storing the invisible window for each pixel. In this case, the need of outputting image data from a video memory each time a change is made from one window to another is eliminated, permitting power dissipation to be reduced significantly.

In addition, it becomes possible to provide users with such services as remove a background that should be kept from other persons during telephone conversation through video phones and instead display a favorite background image or an image with which an operator will not be bored in the middle of computational processing at the time of execution of an application.

Second Embodiment

Figure 6:
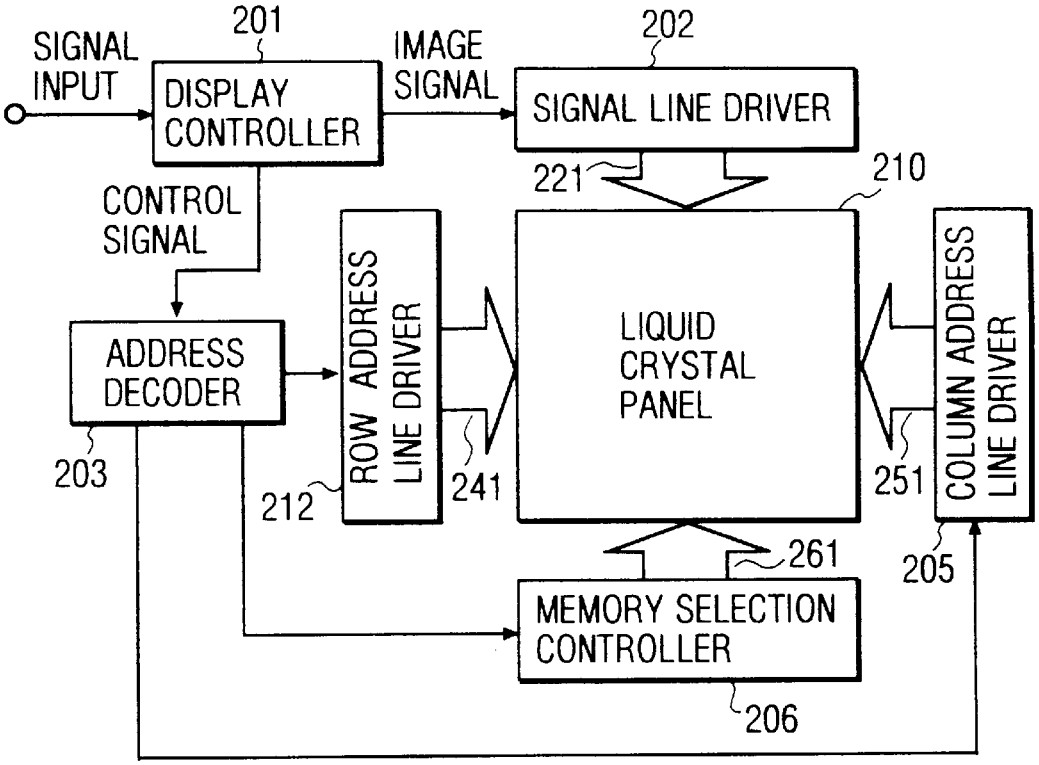
FIG. 6 is a schematic illustration of a liquid-crystal display device according to a second embodiment of the present invention.

In FIG. 6, there is illustrated in block diagram form an arrangement of a liquid crystal display device according to a second embodiment of the present invention. This liquid crystal display device features the provision of a row address line driver 212 and a column address line driver 205 which permit any pixel to be written into independently, an address decoder 203 for controlling the address line drivers 212 and 205, and a memory selection controller 206 for switching between display images.

An input signal supplied from the side of information equipment (hereinafter referred to as the host system side), such as a computer which supplies the liquid crystal display device with image data, is separated by a display controller 201 into an image signal to be applied to a signal line driver 202 and a control signal to be applied to the address decoder 203.

The image signal applied to the signal line driver 202 is applied to a display panel 210 as an image signal 221 which has been boosted up to a voltage necessary for display. The image signal 221 is applied to a memory circuit built into the display panel 210. The control signal is input to the address decoder 203 where a determination is made as to which of pixels in the display panel 210 the image signal 221 is to be written into. The address decoder further determines which of memories in the memory circuit is to be written into.

Like the signal line driver 202, the row address line driver 212, the column address line driver 205 and the memory selection controller 205 each boost a control signal input according to the result of decoding by the address decoder 203 up to a voltage necessary to update the contents of the memory circuits in the display panel 210 and provide the boosted control signal to each of the memory circuits.

Figure 7:
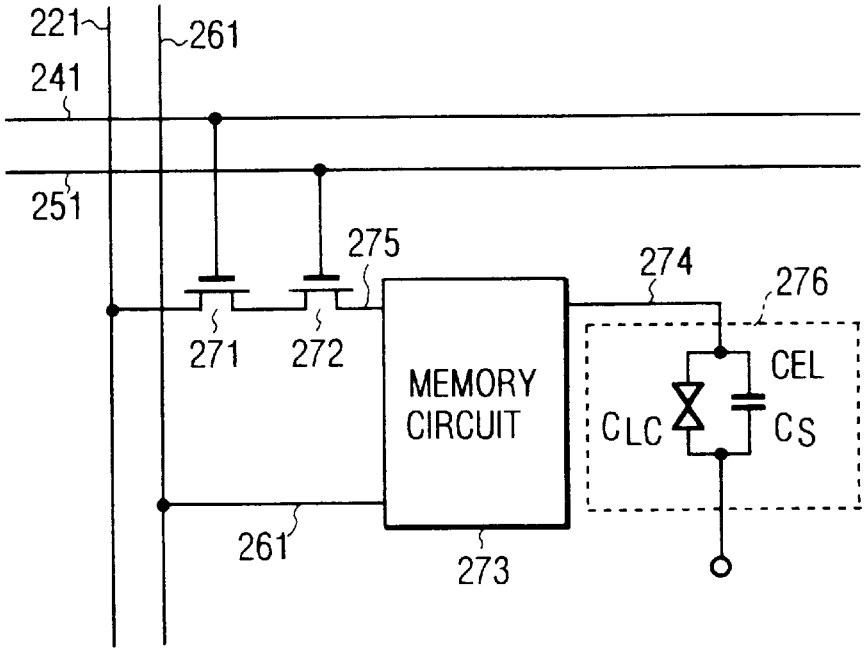
FIG. 7 illustrates one pixel and its associated circuit of the liquid-crystal display panel of FIG. 6.

FIG. 7 shows an example of a circuit arrangement associated with one pixel in the display panel 210. In this example, the image signal 221 from the signal line driver 202 is connected to one end of an image signal switch 271 which is rendered conductive (ON) by a row address line drive signal 241. The switch 271 has its other end connected to one end of a switch 272, which is rendered conductive by a column address line drive signal 251 and has its other end connected to a memory circuit 273. Thus, unless the switches 271 and 272 are rendered conductive simultaneously, the image signal 221 will not be input to the memory circuit 273. In other words, a combination of an row address and a column address permits an image signal to be written into the pixel at a given location.

Which of memories in the memory circuit is to be updated or which of the memories is to be used to drive a liquid crystal cell 210 is determined by a switch signal 261 from the memory selection controller 261.

Figure 8:
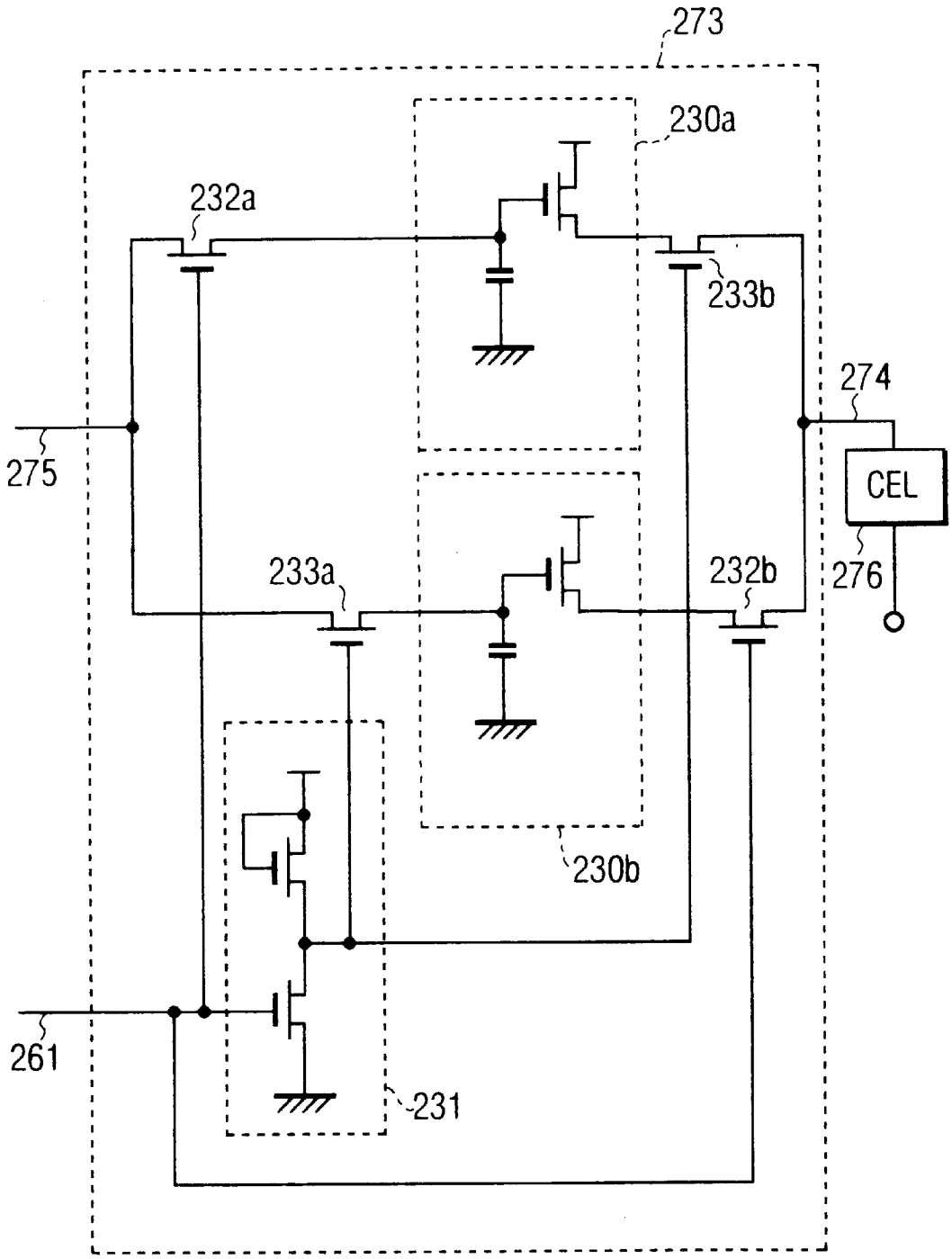
FIG. 8 illustrates an example of a dynamic type of memory circuit of the liquid-crystal display panel of FIG. 6.

FIG. 8 shows a first circuit arrangement of the memory circuit 273. In this circuit, an image signal 275 from the switch 272 is applied to transfer gates 232*a* and 232*b* and transfer gates 233*a* and 233*b*. The transfer gates 232*a* and 232*b* are turned ON when the switch signal 261 is high, while the transfer gates 233*a* and 233*b* are turned ON when the switch signal 261 is low. The switch signal 261 is applied to the gates of the respective transfer gates 232*a* and 232*b* and the input of an inverter 231 which inverts the switch signal 261. The inverted switch signal is applied to the gates of the respective transfer gates 233*a* and 233*b*.

In the example of FIG. 8, when the switch signal 261 is high, a memory 230*a* is updated and a liquid crystal drive signal 274 for driving the liquid crystal cell 276 is determined by the contents of a memory 230*b*. Each of the memories 230*a* and 230*b* is of a DRAM type, which is comprised of one transistor and one capacitor. In order for each memory cell to operate properly, it is required to update (refresh) the memories 230*a* and 230*b* at regular intervals.

Figure 9:
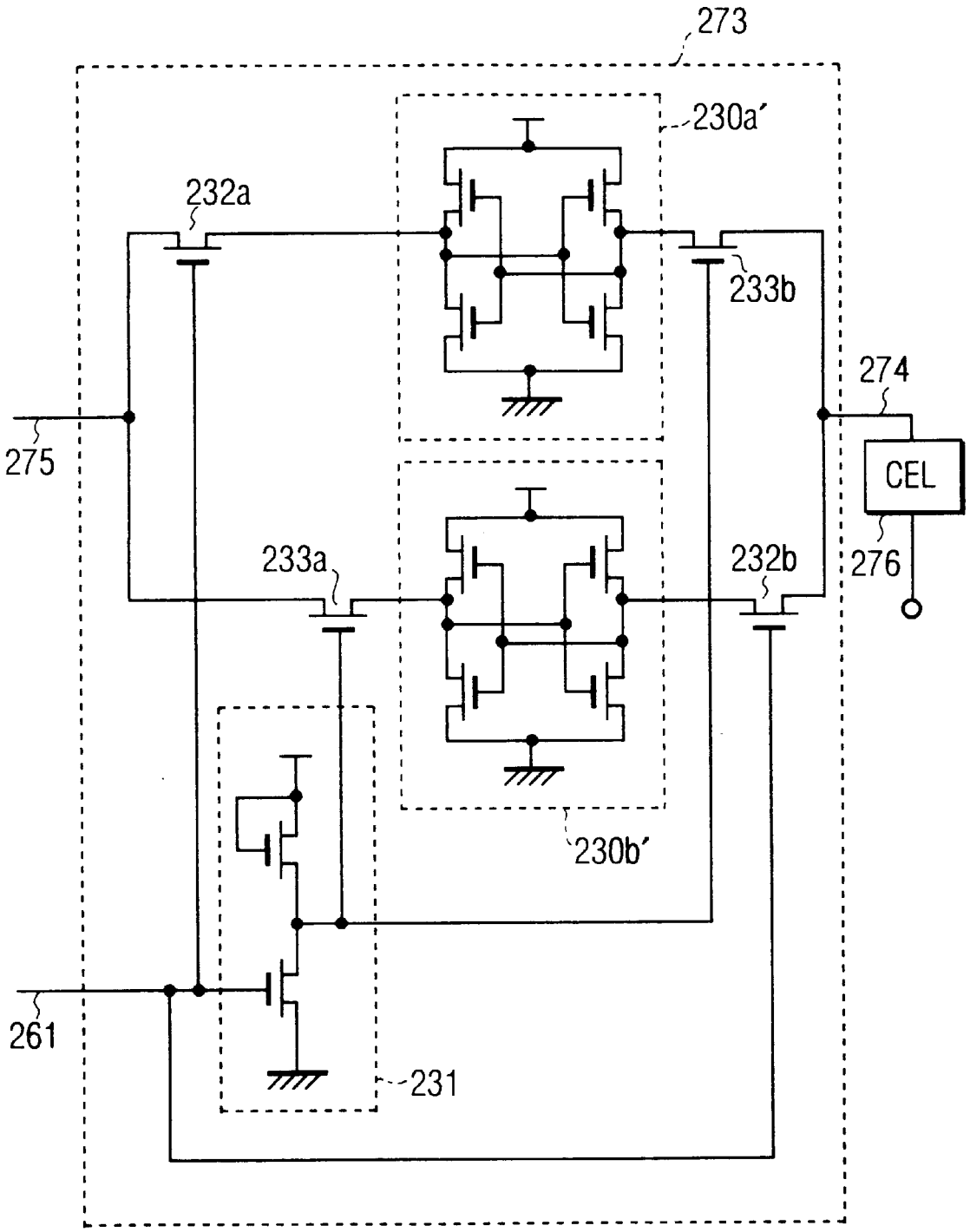
FIG. 9 illustrates an example of a static type of memory circuit of the liquid-crystal display panel of FIG. 6.

FIG. 9 shows a second circuit arrangement of the memory circuit 273. This memory circuit is of a static type requiring no refreshing. Thus, once an image signal is written into the memory circuit 273, the signal will be held there until the next image signal is written. For signal writing and liquid crystal driving, the arrangement of FIG. 9 is identical to the arrangement of FIG. 8. That is, when the switch signal 261 is high, the contents of a memory 230*a*' is updated and the drive signal 274 for driving the cell 276 is determined by the contents of a memory 230*b*'.

If the memory circuit 273 is of a static type as shown in FIG. 9, an image signal can be written into the memory circuit only when the display contents are changed. Thus, the transfer of image data from the host system side to the display side is simply made only when the display image is updated.

Figure 10:
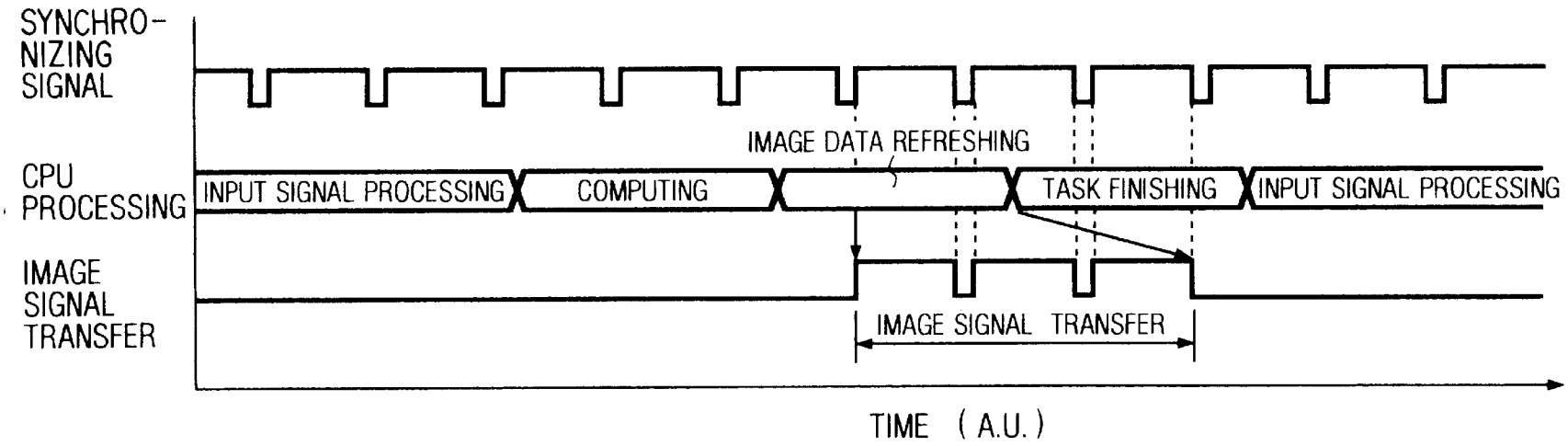
FIG. 10 is a timing diagram explanatory of a first example of a display signal transmission scheme in the liquid-crystal display device of the second embodiment.

FIG. 10 is a timing diagram for image signal transmission. With a usual display device, it is required that the transfer of an image signal be made in synchronism with a synchronizing signal for driving a display device and the transfer of image signals is made constantly. When the memory circuit 273 is of a static type, an image signal is simply transferred after a image updating request has been generated on the CPU side (the host system side). Therefore, less time is required to transfer image signals than in the usual display device, resulting in a reduction in signal transmission power and a decrease in the amount of electromagnetic noise occurring during the transmission of image signals.

As shown in FIG. 10, the operation of displaying an image on the liquid crystal display is performed constantly, which includes refreshing and polarity reversal of image signals. The execution of substantial updating of image signals depends on the time required for and the number of times of updating a video memory storing video data on the host system side. Thus, the speed of updating a display image substantially depends on the speed at which the video memory is updated on the host system side.

When the video memory on the host system side has a storage capacity larger than the total number of the pixels built in the liquid crystal panel, it becomes possible to apparently switch between image signals at a speed higher than the speed of updating the video memory, by updating the contents of image memories, which are built into the display panel and are not in use for display, by data in the video memory on the host system side at the same time the video memory is updated.

Figure 11:
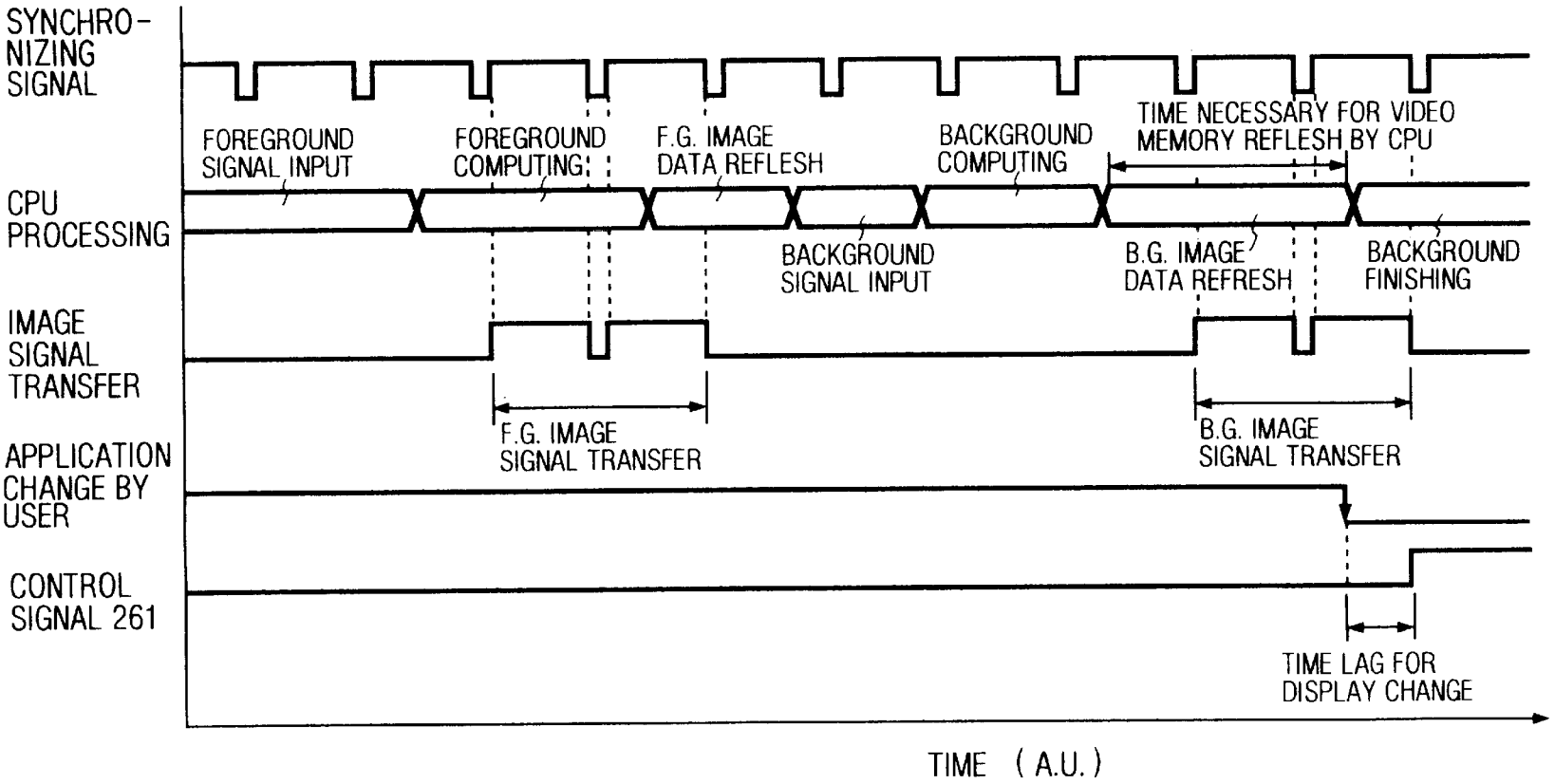
FIG. 11 is a timing diagram explanatory of a second example of a display signal transmission scheme in the liquid-crystal display device of the second embodiment.

As an example, in FIG. 11, there is illustrated a timing diagram of image signal transfer when high-speed switching of image signals is made. For example, assume that the user of the host system performs multitask processing including word processing in the foreground and information retrieval from a database with communications in the background. During document creation by word processing, the background task is carried out when key entry by the user is off.

When access is made to a database for information retrieval in the background, it is necessary to display the results of the retrieval on the screen. To this end, as shown in FIG. 11, the results of computational processing (retrieval matching, retrieving information, etc.) by the background processing program are transferred as background image signals to image memories which, of the image memories built into the display panel, are not in use for display.

That is, in the background processing on the host system side, the memories in the pixels of the display panel are used as a virtual screen and the memory contents are updated by writing means which is the same as image signal updating means of the usual liquid crystal display device. When the user prematurely switches the system application between the background and the foreground, an application switching request by the user permits display images to be switched at high speed, as shown in FIG. 11, in a time shorter than the time required by the CPU to update background display data or without producing any time delay, depending on situation.

Thus, even when the pixel memories in the display panel are updated by a background display image, it is not required to make transfer of image signals themselves constantly in synchronism with a synchronizing signal. As shown in FIG. 11, it is required only that image signal transfer be made only when image signals need updating. Therefore, less time is required to transfer image signals than in the usual display device. This will result in a reduction in image signal transmission power and a decrease in electromagnetic noise that may occur at the time of transfer of image signals.

Next, a description will be given of an application of the present invention to three-dimensional (3D) display utilizing spectacles equipped with liquid crystal shutters. A 3D display can be made by displaying an image for right eye and an image for left eye on the same screen on a time division basis and switching the liquid crystal shutters of the spectacles the user wears in synchronism with the image display.

Figure 12:
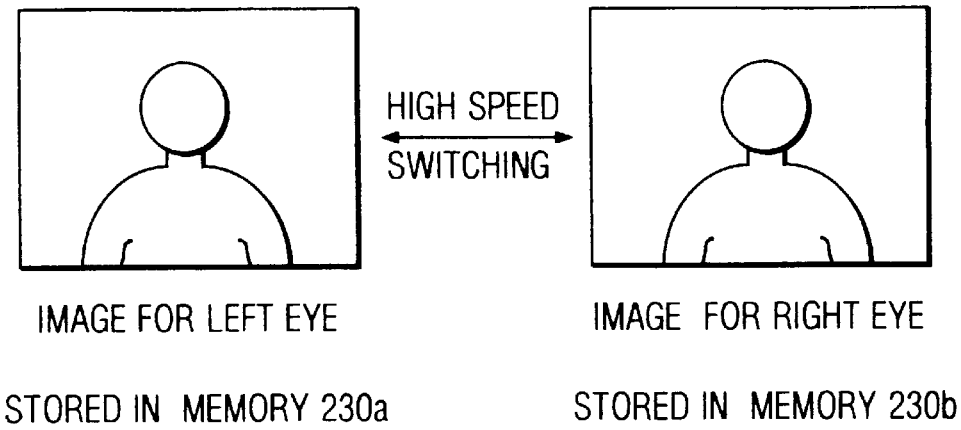
FIG. 12 is a diagram explanatory of an application of the second embodiment to a 3D (three-dimensional) spectacles equipped with liquid crystal shutters illustrating memory images for right and left eyes.

In the 3D display, as shown in FIG. 12, one of an image for left eye and an image for right eye is allocated for a real screen image and the other for a virtual screen image. This allocation is performed in advance on the host system side. The host system simply rewrites only an image which has come to need to be changed. Thus, unlike conventional LC-shutter-equipped spectacles, there is no need of rewriting both the right and left images all the times, and image signals can be updated independently of the timing of vertical synchronization pulses in the liquid crystal display device.

Conventionally, the switching between the right and left images must be made in synchronism with vertical synchronizing pulses sent from the host system side. Normally, the vertical synchronizing pulses have a frequency of 60 Hz. Thus, each of the right and left images is individually displayed only at 30 Hz. Although the liquid crystal display device itself makes a display at 60 Hz, 30 Hz flicker will be observed. However, flicker-free 3D image display can be made by fast switching the memory switch signal 261 for switching between display images.

The memory switching control and the updating of a screenful of image need to be performed under the control of the host system. That is, with the two-memory system as shown in FIG. 8 or FIG. 9, when the image for right eye is being displayed, only the image for left eye can be updated. Thus, the updating need be restricted to the image which is opposite to the image that is being displayed. This problem can be solved by allowing each pixel to have more than two memories, e.g., four memories.

That is, the first and second memories store right and left images, which are to be displayed switched at high speed. The third and fourth memories store right and left images to be displayed next. If, in this case, updating is performed on the images in the third and fourth memories, then the timing of updating of images will not be affected by the timing of switching of the display images. As the memory switching signal 261 becomes faster, the displayed images become smoother, allowing a display as if the right and left images were displayed all the time.

In other words, by switching the memories at high speed, the number of pixels of the display panel is considered to be equivalently increased up to the number of pixels for both the right and left images, i.e., by a factor of two. Thus, display quality is improved. In this way, a flicker-free high-quality 3D display can be made by switching right and left images at high speed independently of the synchronizing signal of the display device.

As described above, according to the second embodiment, the stored contents of memories other than memories for supplying image data to display cells are updated according to the results of a task which is executed in the background on the host system side. Thus, when the application is switched from one to another on the host system side, high-speed switching can be made between a display image and an in-memory image, allowing the time required to update the on-screen contents to be reduced.

In addition, by storing image signals into memories built in the display cells and switching between the current image signals and the image signals in the memories at high speed for driving the display cells, images can be displayed with pixels which are equivalently larger in number than the display cells. Thus, a high-definition, low-power-dissipation display device can be implemented.

Third Embodiment

Figure 13:
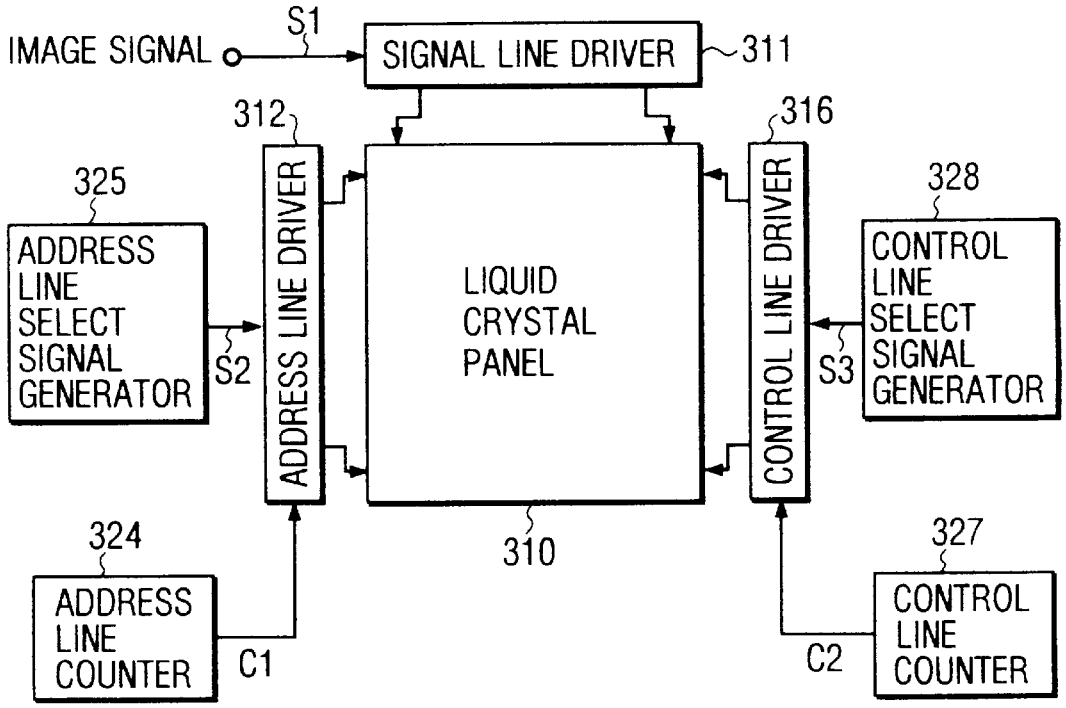
FIG. 13 is a schematic illustration of a liquid-crystal display device according to a third embodiment of the present invention.

FIG. 13 is a schematic illustration of a liquid crystal display device according to a third embodiment of the present invention. As shown, the display device includes a liquid crystal display panel 310, a signal line driver 311, an address line driver 312, an address line counter 324, an address line select signal generator 325, a control line driver 326, a control line counter 327, and a control line select signal generator 328.

An image signal S1 is input to the signal line driver 311 and, at the same time, an output signal C1 is output from the address line counter 324 to select each of address lines (not shown) in sequence. The selection/nonselection of a given address line is determined by an address line select signal S2 output from the address line select signal generator 325. Likewise, each of control lines (not shown) is selected in sequence with each output signal C2 of the control line counter 327. The selection/nonselection of a given control line is determined by a control line select signal S3 output from the control line select signal generator 328.

Figure 14:
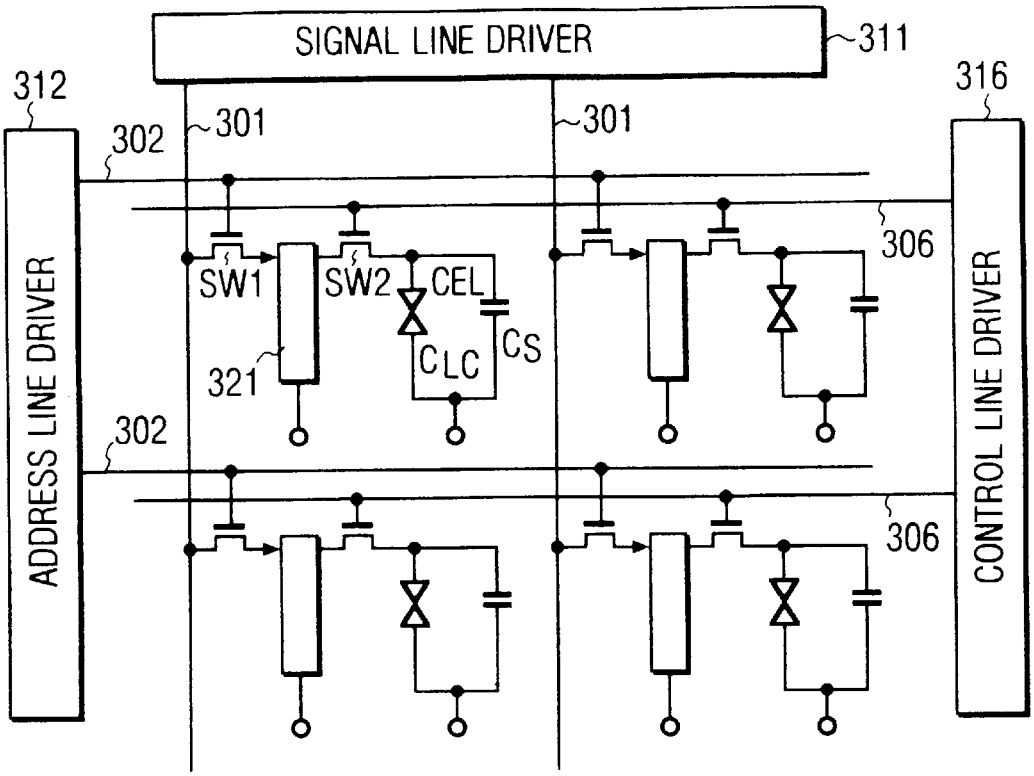
FIG. 14 is a schematic illustration of a basic liquid-crystal display panel of the third embodiment.

FIG. 14 shows a schematic arrangement of cells in the liquid crystal panel of the present embodiment. The basic cell comprises a liquid crystal cell CEL consisting of a liquid crystal capacitor CLC and an auxiliary capacitor Cs, a memory circuit 321, and switches SW1 and SW2.

The switch SW, which is formed of an FET, has its gate connected to an address line 302 and its source connected to a signal line 301. The memory circuit 321 is connected between the drain of the switch SW1 and the source of the switch SW2 which has its gate connected to a control line 306.

The address line driver 312 outputs an ON voltage onto the address line 312 and then the control line driver 316 outputs an ON voltage onto the control line 306. When the switch SW2 is turned ON, a pixel signal is transferred from the corresponding memory circuit 321 to the corresponding pixel cell CEL.

Conventionally, in writing pixel signals into pixels arranged in rows and columns, address lines arranged in rows are scanned in sequence from top to bottom, all the switches connected to an address line being scanned are turned ON simultaneously to thereby permit each of signals appearing at this point on signal lines to be written into the electrode of a respective one of pixels corresponding to that address line. That is, in the conventional technique, even in the case where the same image is displayed in the previous field and the next field, the same image signals must be applied to the pixels with each field.

According to the present embodiment, the provision of the control lines 306 and the control line driver 316 eliminates the need of transferring image signals from the computer side to pixels which have no need to change image information. Thus, power dissipation of the liquid crystal cells and peripheral circuitry can be reduced significantly. The power required to drive the signal lines is much larger than the power required to drive the liquid crystal cells. It is therefore a great advantage that unnecessary driving of signal lines can be avoided.

Figure 15:
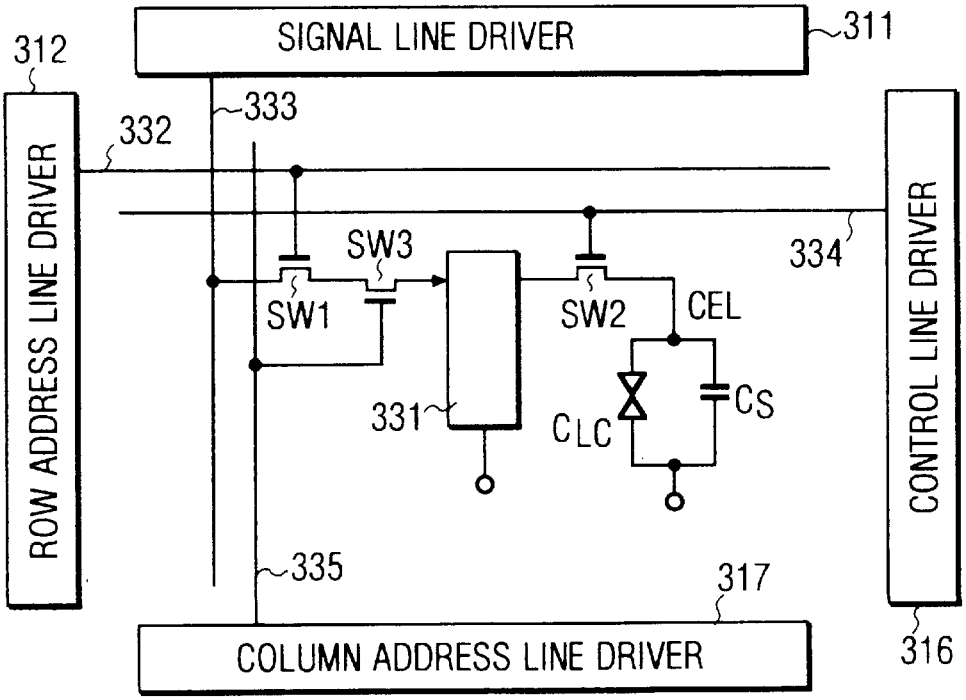
FIG. 15 is a schematic illustration of a liquid-crystal display panel of the third embodiment arranged such that each memory circuit can be selectively written into.

FIG. 15 shows a modification of the cell arrangement of the present embodiment, which allows each memory circuit to be selectively written into. This arrangement is characterized by further comprising column address lines 335, a column address line driver 317, and switches SW3 each of which is connected between the switch SW1 and the memory circuit 331 and controlled by a corresponding one of the column address lines.

Each memory circuit 331 is written into when the corresponding row address line 332 and the corresponding column address line 335 are supplied with an ON voltage simultaneously. Thus, each of the memory circuits arranged in a column can be written into selectively. In addition, by driving successive row address lines and successive column address lines, the memory circuits can be written into on a block-by-block basis.

Figure 16:
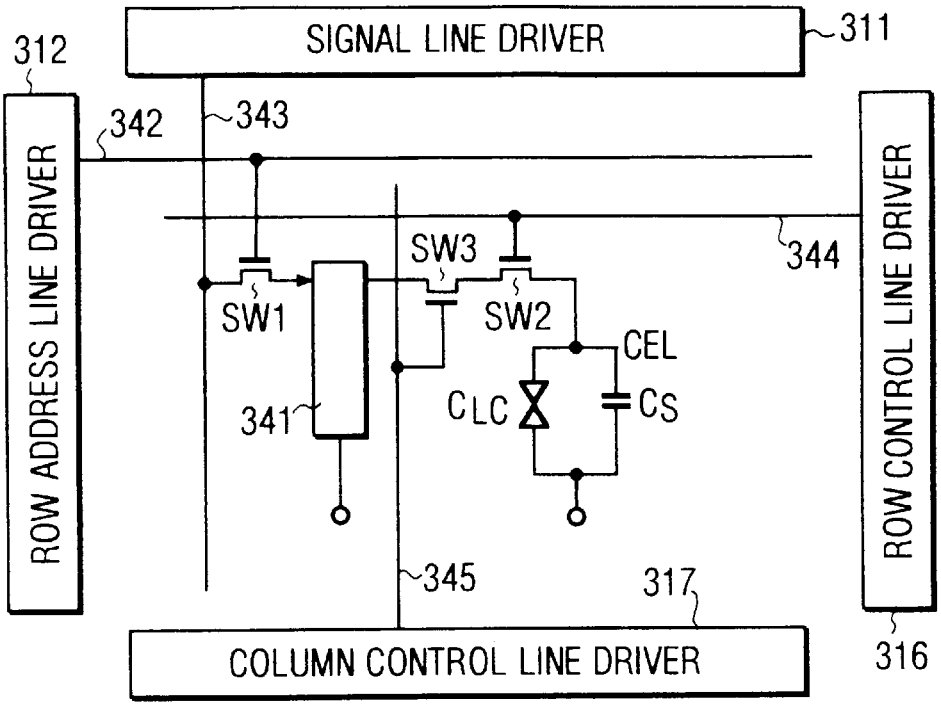
FIG. 16 is a schematic illustration of a liquid-crystal display panel of the third embodiment arranged such that each memory circuit can be selectively written into.

FIG. 16 shows a cell arrangement which allows each of display elements to be written into selectively. In this arrangement, the switch SW3 is connected between the memory circuit 341 and the switch SW2. Each display element CELL is written into when the corresponding row control line 344 and the corresponding column control line 345 are supplied with an ON voltage simultaneously. Thus, each of the display elements arranged in a column can be written into selectively. In addition, by driving successive row control lines and successive column control lines, the display elements can be written into on a block-by-block basis.

In the arrangements of FIGS. 15 and 16, the switches SW1, SW2 and SW3 can be operated properly to selectively perform direct writing into the display elements, writing into the memory circuits only, or no writing.

Fourth Embodiment

Figure 17:
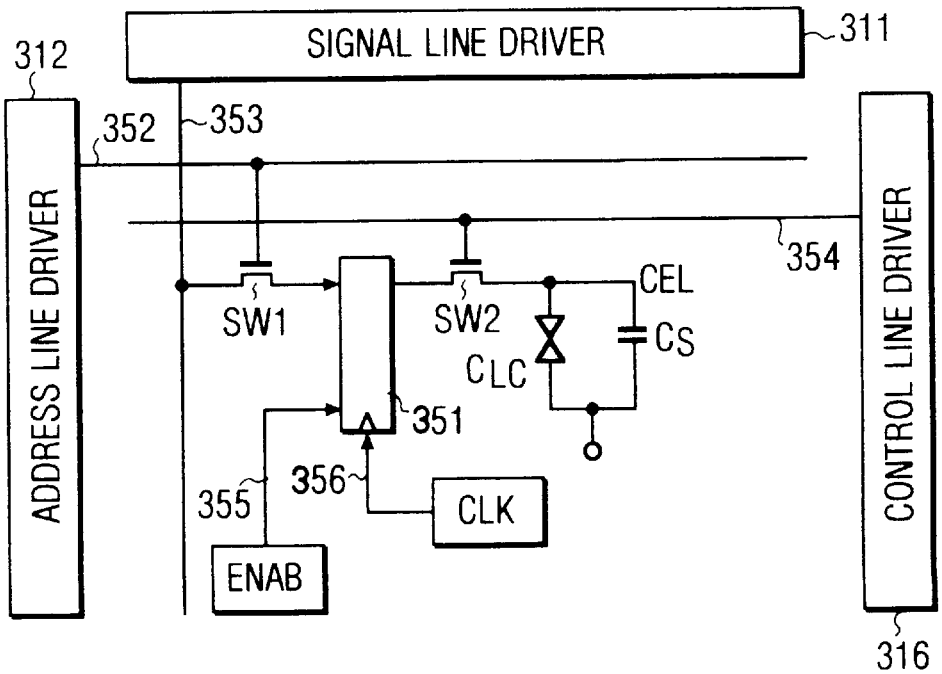
FIG. 17 is a schematic illustration of a liquid-crystal display panel of a fourth embodiment of the present invention.

A fourth embodiment is an application of the third embodiment and relates to FRC (Frame Rate Control) which displays a halftone or shade of gray by switching between display colors A and B. FIG. 17 shows a schematic cell arrangement. Like reference numerals are used to denote corresponding parts to those in the third embodiment and description thereof is omitted.

A memory circuit 351 has two or more memories to store at least two signals for different display colors. By changing a composite synchronization signal (hereinafter referred to as ENAB), each memory is supplied with a signal for color A or color B over the corresponding signal line 353.

The memory circuit is read from in synchronism with clocks CLK. Writing into the display element is controlled by the control line 354. Thus, the FRC switching frequency can be changed by changing the frequency of the clocks CLK to the memory circuit. Assuming the switching frequency to be 120 Hz, flicker due to switching will be 60 Hz in frequency, whereby no flicker is observed.

By making signals that are the same for image information but opposite in polarity correspond to display colors A and B, the polarity reversal can be performed in synchronism with clocks.

Fifth Embodiment

Figure 18:
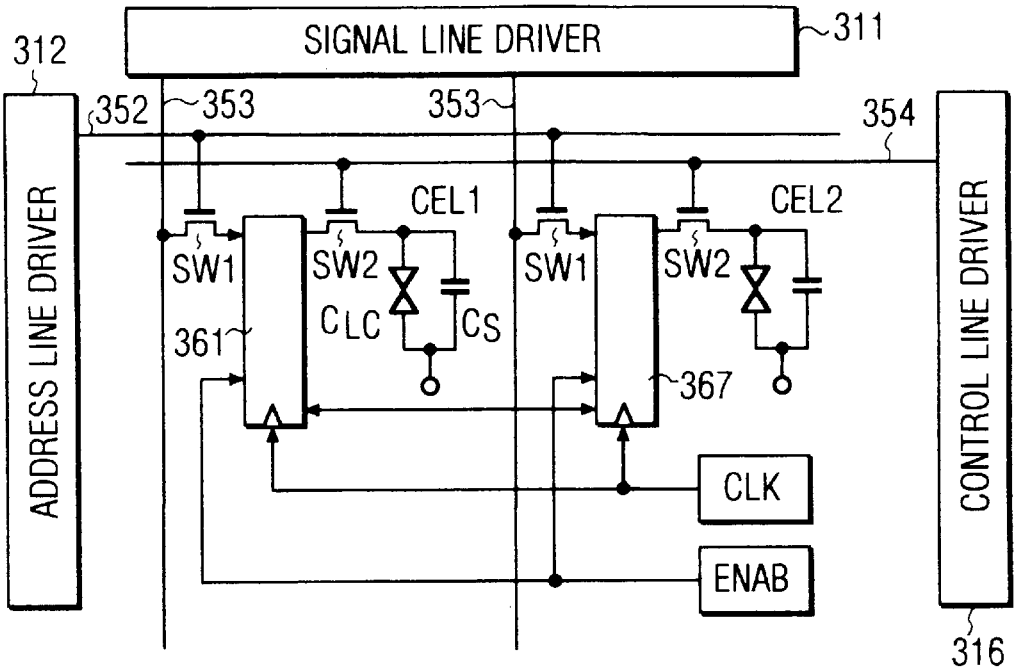
FIG. 18 is a schematic illustration of a liquid-crystal display panel of a fifth embodiment of the present invention.

A fifth embodiment, which is a modification of the fourth embodiment, relates to communication of display colors between adjacent memories in the dithering or error diffusion method which displays shades of gray by modulating display colors A and B spatially. In FIG. 18 there is shown a schematic cell arrangement of the fifth embodiment.

In each of memory circuits 361 and 367 of respective pixel cells CEL1 and CEL2 which are disposed adjacent to each other, a display color to be written into the corresponding pixel is selected by ENAB. In synchronism with clocks CLK, a shift of image information is made from the memory circuit 361 to the memory circuit 367 and vice versa.

Figure 19A:
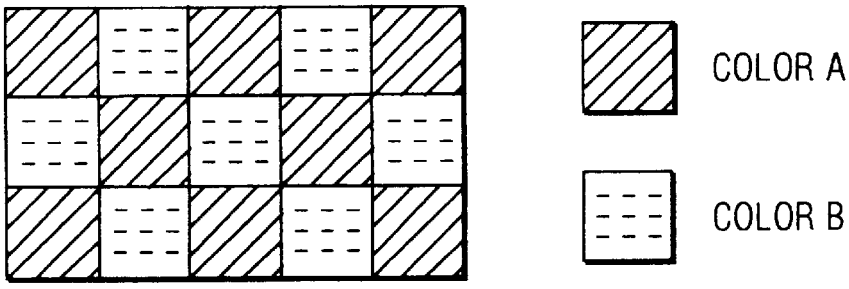
FIGS. 19A and 19B are diagrams illustrating the display differences in checkered pattern between the fifth embodiment and the conventional liquid-crystal display device.
Figure 19B:
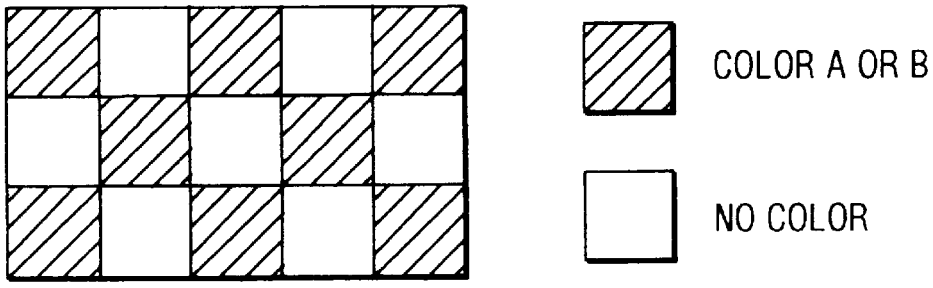
F I G. 19B PRIOR ART

Conventionally, only one of the display colors A and B will be displayed as shown in FIG. 19B when a checkered pattern is displayed by means of the dithering method which produces shades of gray by spatial modulation between adjacent cells. In the present embodiment, however, since the other display color can be received from the adjacent pixel, both the display colors A and B can be displayed as shown in FIG. 19A. Note that the spatial modulation is performed in the time axis direction.

The combined use of the fourth and fifth embodiments will further improve picture quality.

Sixth Embodiment

Figure 20:
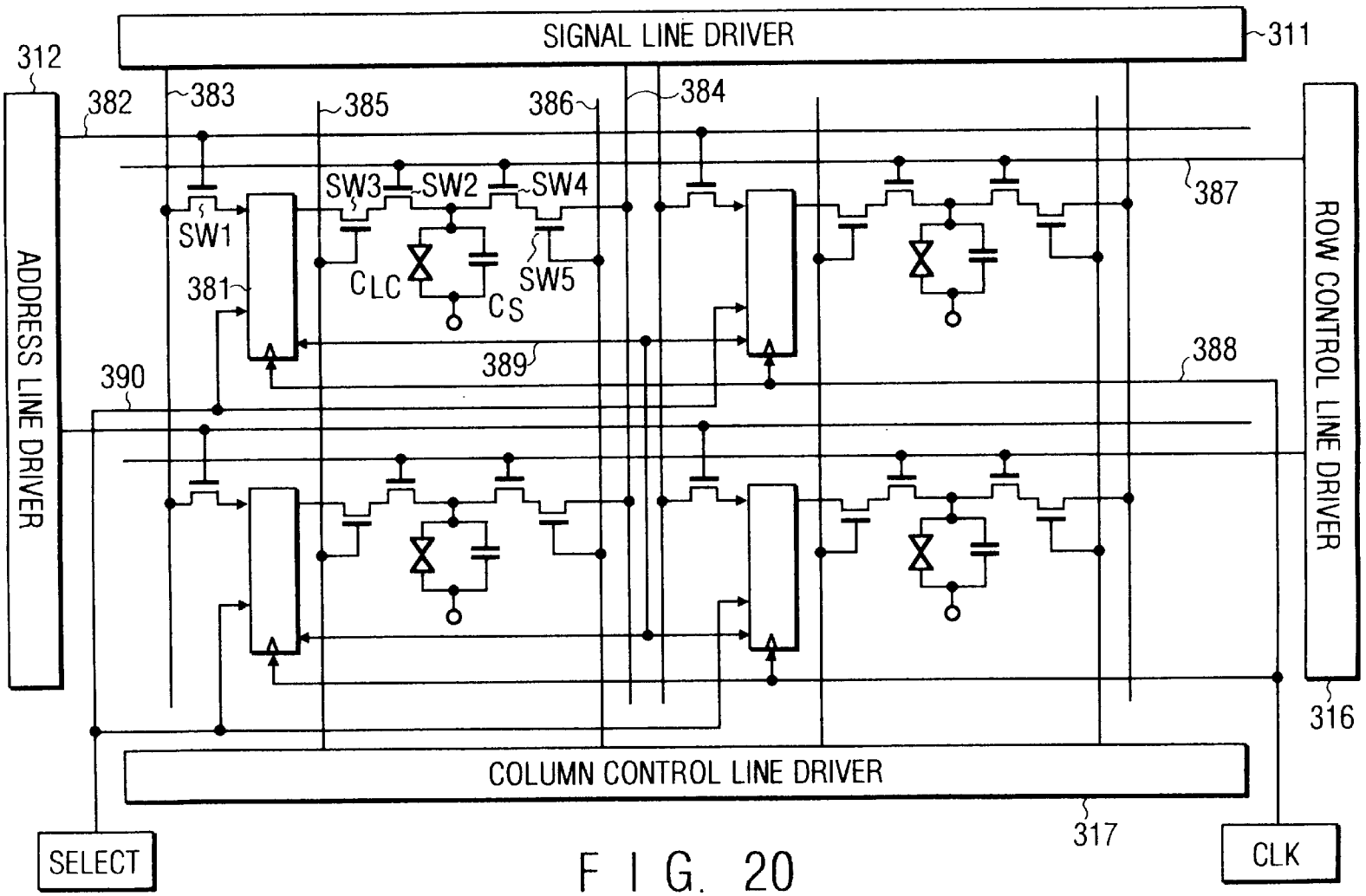
FIG. 20 is a schematic illustration of a liquid-crystal display panel of a sixth embodiment of the present invention.

A sixth embodiment relates to an arrangement in which each pixel has a memory circuit with a shift register function and other means for writing an image signal into the pixel electrode. In FIG. 20 there is shown a schematic arrangement of cells of the present embodiment.

A memory circuit 381 having a shift register function transmits data to or receive from an adjacent pixel over a data transmission line 389 in synchronism with clocks on a clock signal line 388. In this case, a select signal on a select signal line 390 selects one of data transfer between adjacent pixels arranged in a row (left-to-right direction) and data transfer between adjacent pixels arranged in a column (up-to-down direction).

The memory circuit 381 is written into when an image signal is output from a signal line driver 311 onto the corresponding signal line 383 and the corresponding address line 382 is driven by an address line driver 312. For writing into the pixel cell, when an ON voltage is applied to both the corresponding row control line 387 and the corresponding first column control line 385, image information is written into the cell by the corresponding memory circuit. On the other hand, when an ON voltage is output onto the corresponding row control line 387 and the corresponding second column control line 386, an image signal is directly written into the corresponding pixel cell by the corresponding signal line 384.

In other words, the display device of the sixth embodiment has two image input means for each pixel. This will allow the use of the memory circuits to store a background image and the use of the second input means to directly write a moving object into pixels.

In displaying a window of moving image on a still image, image information for the still information can be written into the memory circuits and the moving image can be directly written into the display elements by the use of the second input means. By so doing, the still image can be displayed with the drive frequency lowered and the moving image can be displayed at a high frequency, allowing power dissipation to be reduced and picture quality to be further improved.

An image held in the memory circuits can be scrolled easily by means of clock signals and select signals.

Seventh Embodiment

If, in the third through sixth embodiment, each memory circuit has several registers, then a window image, an initial display, and a display when the computer is turned off can be recorded. A seventh embodiment is directed to such a system. Using this system, image information having the screen saving effect can be recorded into the memory circuits and then written into the pixel cells to protect against screen burn when inactivity lasts over a long length of time. In this case, the transfer of image signals from the computer is not needed, resulting in a reduction in power dissipation.

As described above, according to the third to seventh embodiments, image information which has been recorded into the memory circuits can be used to write into the display elements. When there is no difference in image information between the previous field and the next field, the need of data transfer between the host system (computer) and the display device is eliminated, resulting in a reduction in power dissipation. In addition, when image information is held in the memory circuits, power dissipation can be reduced without decreasing the number of times that the display elements are written into.

In the FRC or dithering method which displays shades of gray by using a plurality of display colors, flicker or erroneous display may occur, depending on the pattern of a display image. In such a case, within one pixel the display color can be switched from one to another, keeping the picture quality from deteriorating.

Moreover, an image which may be scrolled can be recorded into the memory circuits and a moving object can be directly written into the display elements. Thus, the number of transfers of signals for that image from the computer to the display device can be reduced significantly to reduce power dissipation. Further, the moving object can be rewritten at optimum drive frequency to make a more realistic display.

Furthermore, various pieces of image information can be held in the memory circuits to allow high-speed image switching. If image information is retrieved from the memory inside the host system and then transferred to the display device, then a time delay will be involved in switching windows. According to the arrangement of the invention, access can be made to image information in the memory circuits in the display device after display image has been switched once, which further improves ease of use by the user.

Eighth Embodiment

The embodiments described so far can reduce power dissipation only when exactly identical images exist as with images of one-frame before or background images. In an eighth embodiment, a description is given of a method which not only selects the most correlated image from among images held in memories but also transfers the difference therebetween. Even if images are not exactly identical to each other, only the difference is required to be transferred, lowering the drive voltage and reducing power dissipation.

Figure 21:
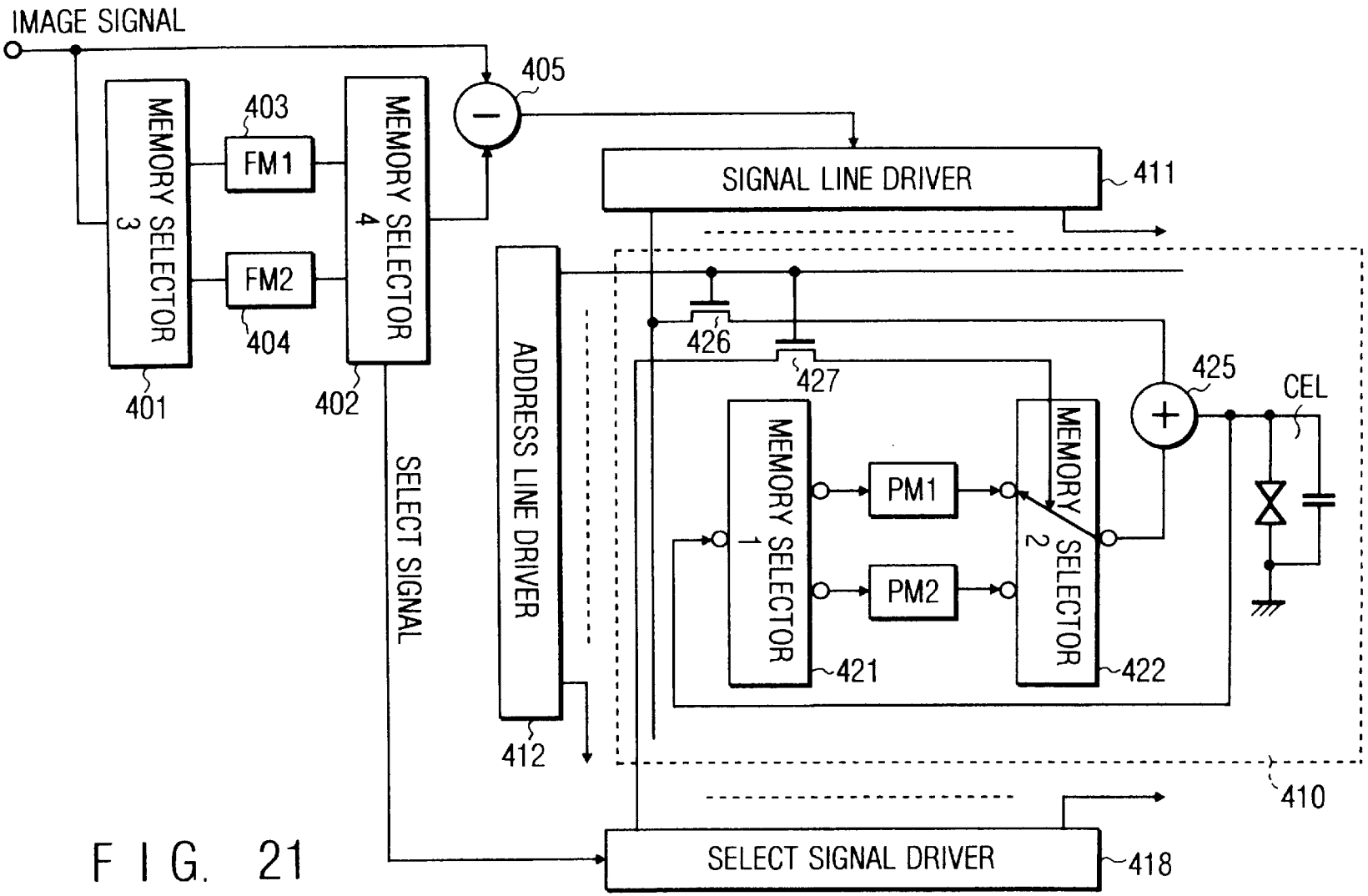
FIG. 21 is a schematic illustration of a liquid-crystal display panel of an eighth embodiment of the present invention.

FIG. 21 is a schematic illustration of a liquid crystal display device according to the eighth embodiment of the present invention. A liquid crystal display panel 410 includes pixels arranged in rows and columns, a signal line driver 411 for providing image signals onto signal lines extending in the direction of columns, an address line driver 412 for driving address lines row by row, and a select signal driver 418 for providing memory select signals each to make a selection of memory circuits in a corresponding pixel. For simplicity, only one pixel is illustrated in the display panel 410. Each pixel includes two memory circuits PM1 and PM2, first and second memory selectors 421 and 422, an adder 425, a switch 426 interposed between the corresponding signal line and the adder 425, and a switch 427 interposed between the select signal driver 418 and the second memory selector 422. As external circuits of the display panel, there are provided two memory circuits FM1 and FM2, third and fourth memory selectors 401 and 402, and a subtracter 405.

In the first place, of a plurality images stored in memory circuits of an external circuit, the most correlated image with an image to be transferred (an input image) is selected on the image transfer side. In this case, assume that two images are stored in the memory circuits FM1 and FM2, respectively, and the memory circuit FM2 stores a background image. A difference between a selected one of the two image signals and an input image signal is produced by the subtracter 405, which, in turn, is sent to the signal line driver 411 along with a select signal indicating which signal has been selected.

In the display panel on the receiving side, the adder 425 in each pixel adds an image signal stored in a corresponding one of the memory circuits PM1 and PM2 which store the same image signals stored in the memory circuits FM1 and FM2, respectively, and the difference signal externally transferred to recover the image signal. The selection between the memory circuits PM1 and PM2 is made by the select signal driver 418 through the second memory selector 422, the select signal driver receiving the select signal from the fourth memory selector 402. If the recovered signal is background, the contents of a background memory are updated.

Such a method in which one of stored images is selected and the difference between the selected one and an input image is transferred is already performed by the data compression method MPEG which is a standard data transmission technique. It is therefore possible to share the external circuits with the data compression technique.

Conventionally, even if the compression technique is used for signal transfer, signals are decompressed and then applied to the liquid crystal panel. That is, even if image signals are transferred as compressed, the image signals are decompressed at the display device. Thus, the amount of information increases uselessly and power dissipation increases correspondingly. According to the present invention, however, signals are transferred as they are compressed in the form of difference until they reach pixels. Thus, an increase in the amount of information to be transferred can be checked.

Figure 22:
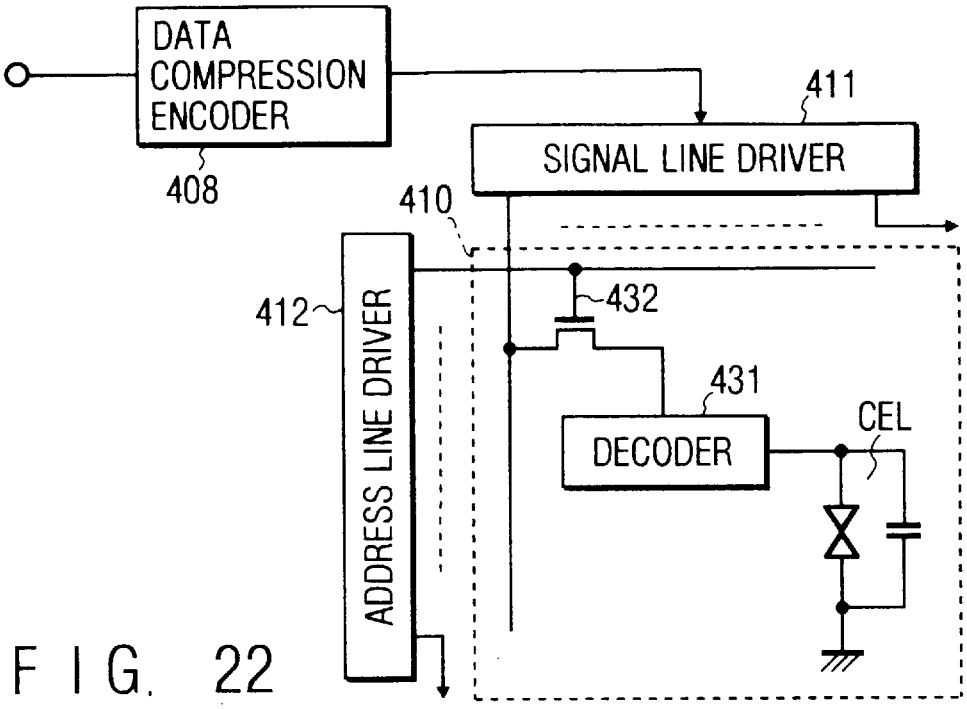
FIG. 22 is a schematic illustration of a modification of the liquid-crystal display panel of FIG. 21.

In this embodiment, the current image is compared with a background image or an image of one frame before to produce the difference from the one to which it is more correlated. This may be implemented by a method shown in FIG. 22 which compresses not only an image at the same location but also an image at another location and motion vectors in an image of one frame before by means of a similar process to the MPEG and decompresses them in the pixel. In FIG. 22, 408 denotes a data compression encoder installed external to the liquid crystal display panel 410, and 431 denotes a decoder installed for each pixel.

Ninth Embodiment

The arrangement of the display device of the present invention such that each pixel has a plurality of memories can be applied to a pen-input display device. With a conventional pen-input display device, since the time resolution is required to be not less than 60 points per second, pen-input information must be transferred regularly at intervals of about 17 msec. For this reason, the CPU uses a several percentage of the transfer time for pen input and a driver for transferring pen-input coordinates to the CPU must also operate every 17 msec, preventing power dissipation from reducing. (SID87 DIGEST An Electronic Podium for the Classroom, and SID94 DIJEST Electric Inking System Performance)

A ninth embodiment is directed to a display device which lightens the burden imposed on the CPU and reduces the power dissipation of a pen input device.

Figure 23:
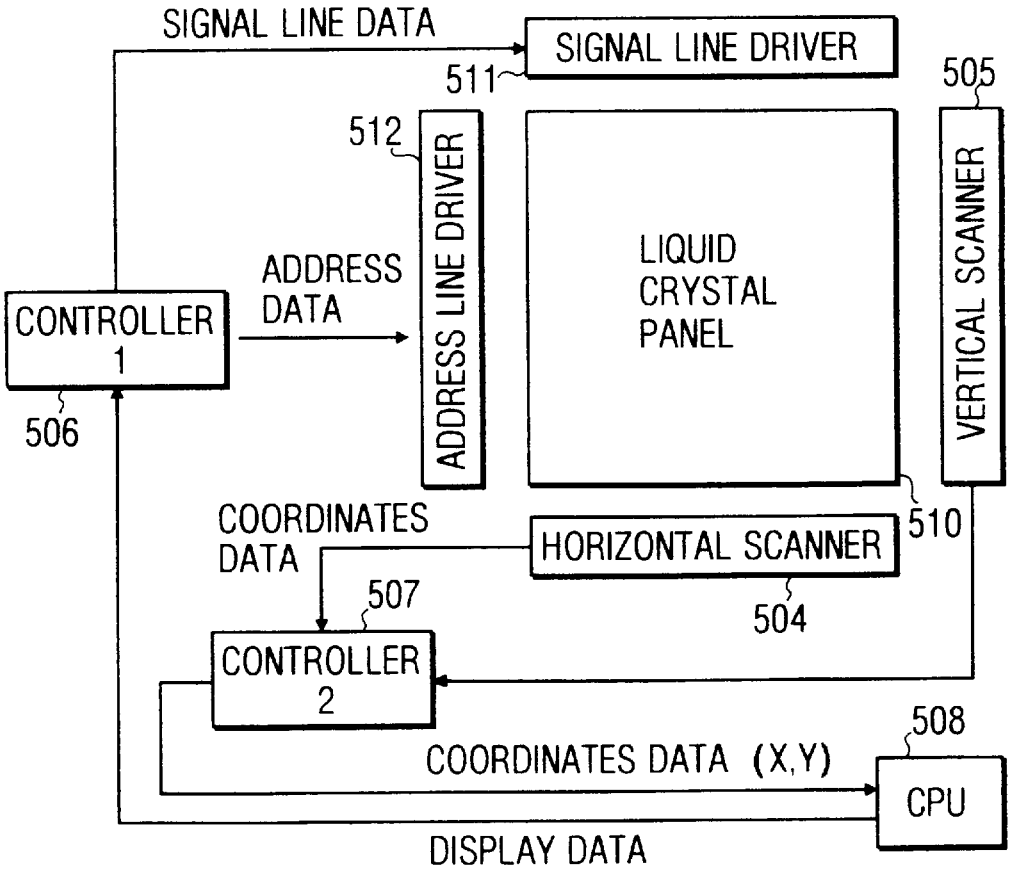
FIG. 23 is a schematic illustration of a pen-input liquid crystal display device according to a ninth embodiment of the present invention.

FIG. 23 is a schematic illustration of a pen-input display device of the ninth embodiment, which comprises a liquid crystal display panel 510 that is arranged such that each pixel is equipped with a photosensor and two or more memory circuits and has a pen input function, a signal line driver for providing signal voltages to the display panel 510, an address line driver 512 for turning switching elements (not shown) arranged on the display panel ON and OFF, a horizontal scanner 504 for fetching coordinate data from the display panel, a vertical scanner 505 for turning switching elements (not shown) arranged on the display panel ON and OFF, a first controller 506 for controlling the signal line driver and the address line driver, a second controller 507 for controlling the horizontal scanner and the vertical scanner, and a CPU 508 which transfers display information to the first controller 506 and receives coordinate information from the second controller.

In operation, when coordinates are designated on the display panel by means of a light pen (not shown), the coordinate position data is stored in a corresponding memory circuit built in the display panel 510. The vertical scanning lines (not shown) are selected in sequence by the vertical scanner 505 and the coordinate data is taken out of the memory circuit by the horizontal scanner 504.

The coordinate data thus taken is sent to the second controller 507 where it is formatted into a transfer signal and then transferred to the CPU 508. The CPU 508 processes the coordinate data and other signals to produce image information for transfer to the first controller 506. The first controller 506 produces display panel driving signals (signal line data and address line data) based on the image information and sends them to the signal line driver 511 and the address line driver 512. In the display panel 510, which has two or more memory circuits for each pixel, an image signal for each pixel is stored in the corresponding memory circuits.

Figure 24:
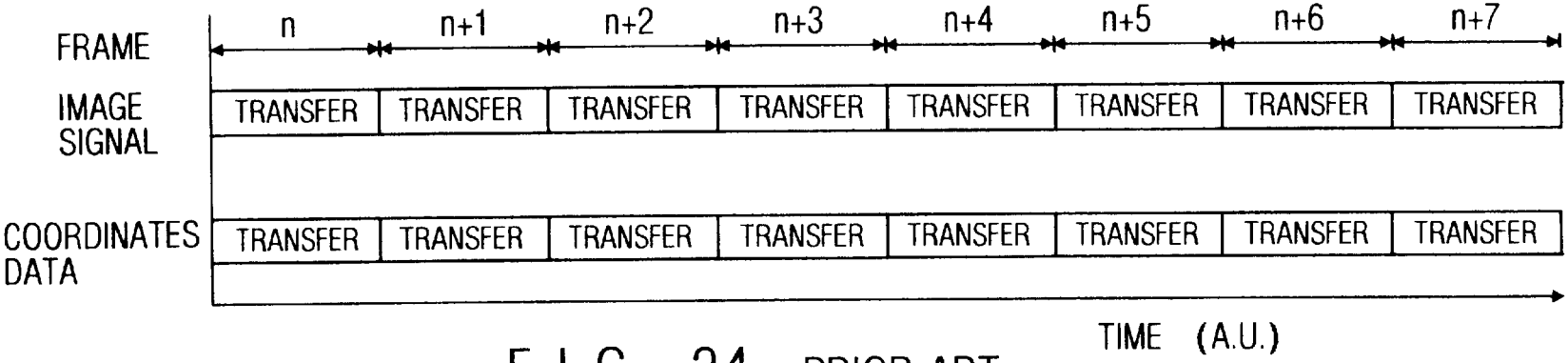
FIG. 24 PRIOR ART
FIG. 24 is a timing diagram explanatory of data transmission in a conventional pen-input display device.
Figure 25:
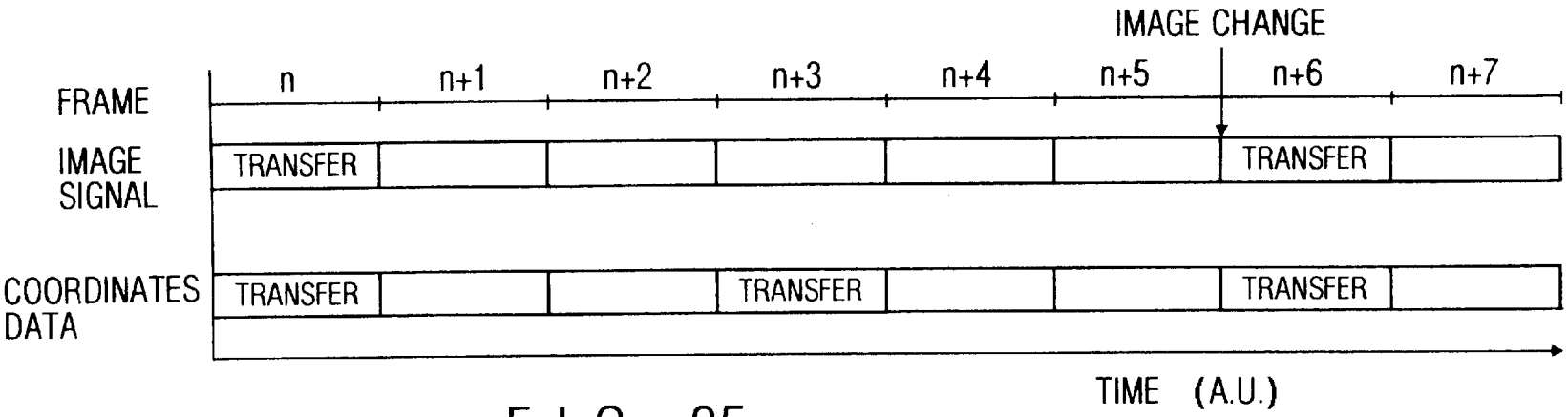
FIG. 25 is a timing diagram explanatory of data transmission in the pen-input display device of FIG. 23.

FIGS. 24 and 25 are timing diagrams illustrating the operating differences between the prior art arrangement in which each pixel has one single memory circuit and the arrangement of the invention in which each pixel has two or more memory circuits.

In the prior art, data must be refreshed regularly as in DRAMs, and, with each frame, an image signal and coordinate data must be transferred to the first controller 506 and the CPU 508, respectively. In the present invention, on the other hand, since an image signal is retained in the memory circuits of each pixel, the need of transferring an image signal with each frame is eliminated until a change occurs in display image. Until then, the display panel will display a still image based on the image signal retained.

When, as shown in FIG. 25, a change occurs in display image in the (n+6)th frame, a new image signal is transferred for that frame. Since the display panel 510 has a coordinate data memory, there is no need of transferring coordinate data with each frame in order to increase the time resolution. The time resolution depends on the time required to read coordinate data into the memory. A photodiode can be used for each coordinate detecting photosensor in the display panel to hold coordinate data in less than several milliseconds.

Moreover, the transfer of coordinate data can be made at low speed, which reduces power dissipation in the horizontal scanner 504, the vertical scanner 505, and the second controller 507. Furthermore, the display device of the present invention has a function of displaying the logical sum of image data and coordinate data retained in the display panel instantly. Thus, as described below, no problem arises in display.

Figure 26:
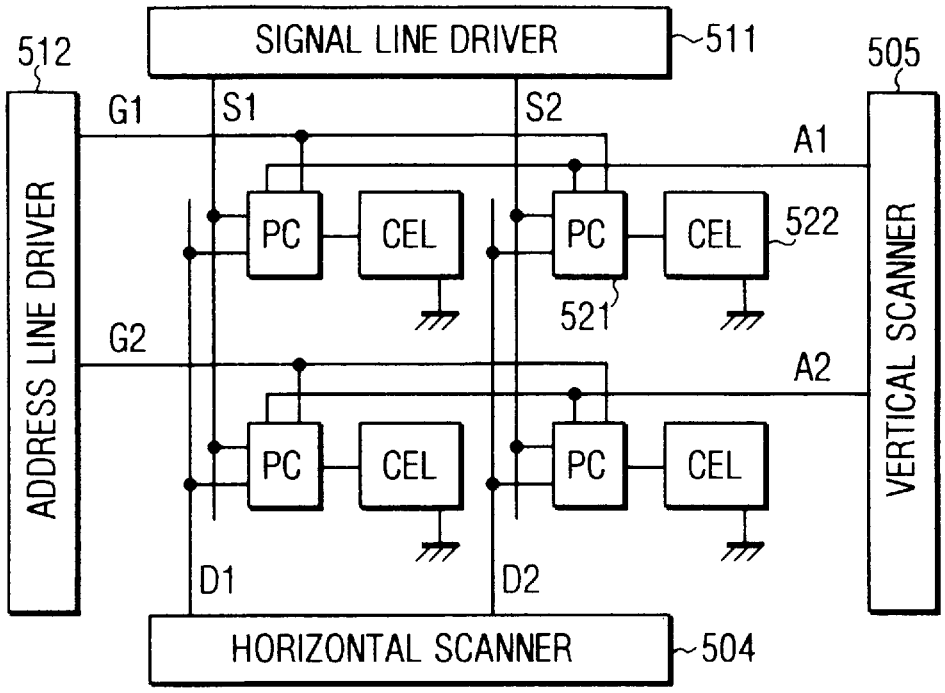
FIG. 26 is a schematic illustration of the liquid-crystal display panel of FIG. 23.

FIG. 26 shows a specific arrangement of each pixel of the display panel 510. Like reference numerals are used to denote corresponding parts to those in FIG. 23 and description thereof is omitted. In FIG. 23, image information output from the CPU 508 is converted by the first controller 506, the signal line driver 511 and the address line driver 512 into image signals and scanning signals corresponding to pixels.

As shown in FIG. 26, the image signals are sent to pixel controllers (PC) 52 and display cells (CELL) 522. The combination of the pixel controller 521 and the display cell 522 is referred to as a pixel. G1 and G2 denote gate lines (address lines). When selected by the address line driver 512 (an ON voltage is applied), the pixel controller 521 receives an image signal from the signal line driver 511 and retains it.

D1 and D2 are horizontal scanning lines which connect the horizontal scanner 504 with the pixel controllers 521. A1 and A2 are vertical control lines, which connect the vertical scanner 505 with the pixel controllers 521. Coordinate data held in the pixel controllers 521 connected to a vertical scanning line that is being selected or scanned by the vertical scanner 505 is sent to the horizontal scanner 504 and then to the CPU 508 via the second controller 507.

Figure 27:
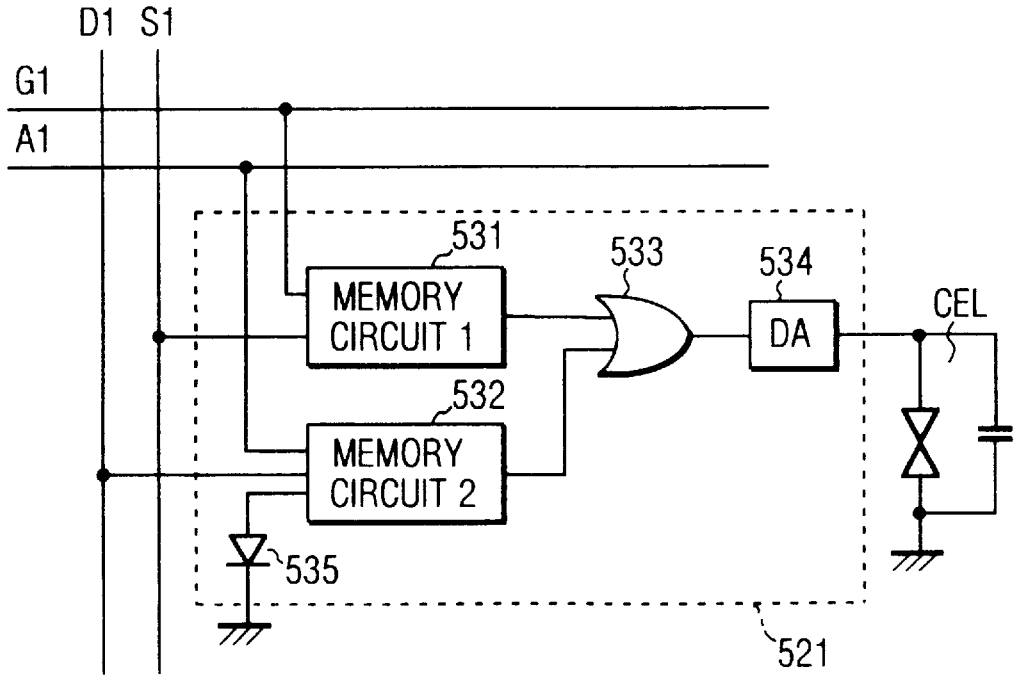
FIG. 27 is a schematic circuit diagram of a pixel control circuit of the liquid-crystal display panel of FIG. 23.

FIG. 27 shows a specific arrangement of the pixel controller 521. Reference numeral 531 denotes a first memory circuit, which, when the corresponding address line G1 is selected or scanned, stores into its internal memory (not shown) a display signal sent over the corresponding signal line S1. Although the display signal is an analog signal, it may be stored in the first memory circuit 531 in either digital or analog form. The image signal is retained in the first memory circuit until the address line G1 is scanned again and a new image signal is sent over the signal line S1.

Reference numeral 532 denotes a second memory circuit, which holds in its internal memory (not shown) coordinate data given by a light pen (not shown) through the display panel 510. When the corresponding vertical scanning line A1, the memory circuit 532 transfers the coordinate data to the horizontal scanner 504 over the corresponding horizontal scanning line D1. Reference numeral 533 denotes an OR circuit which takes the logical sum of the image data and the coordinate data retained in the first and second memories. The logical sum output of the OR circuit is converted by an digital-to-analog (DA) converter 534 into an analog voltage, which, in turn, applied to the display cell 522.

In this embodiment, it is assumed that image data and coordinate data are each a binary signal ("1" or "0"), and "1" indicates black (in pen coordinates, generally indicates that a pen entry is made), while "0" indicates white. If "1" is held in the first memory circuit 531 and "0" is held in the second memory circuit 532, then the OR circuit 533 will apply a voltage corresponding to "1" to the display cell 522. More precisely, the DA converter 534 following the OR circuit 533 will provide a suitable voltage to drive the display cell 522 (for example, 5 volts for TN liquid crystal).

That is, if the second memory circuit 532 holds "1", 5 volts (in the TN liquid crystal case) are applied to the display cell 522 irrespective of whether the coordinate data is read out to the horizontal scanner 504. Thus, even if the speed for the horizontal scanner to read the coordinate data is slow, no inconvenience occurs in display characteristics. Once read out onto the corresponding vertical scanning line A1 selected by the horizontal scanner, the coordinate data in the second memory circuit 532 is erased. This is the case with the first memory circuit 531.

Associated with the second memory circuit 532 is a photodiode 535 which converts light emitted from the light pen into an electric signal, providing data on the coordinates of a pen's input point on the display panel. The memory circuit 532 stores the coordinate data thus obtained in either digital or analog form. When the data is to be held in digital form, a photodiode signal is converted into digital form by a analog-to-digital converter (not shown).

As described above, the pen-input display device of the present invention equips each pixel with a photosensor and two or more memory circuits formed on the same substrate, the photosensor providing coordinate data associated with pen input. The coordinate data is retained in one of the memory circuits. Thus, the speed of the readout of coordinate data during the scanning period is not required to be high, which helps reduce the power dissipation of the readout circuit (the horizontal scanner) and the data transfer circuit.

Moreover, since image data is retained in one of the memory circuits and a voltage corresponding to the logical sum of image data and coordinate data is applied to the display element, the coordinate position can be displayed instantly irrespective of low readout frequency.

Although the invention has been described in terms of a liquid crystal display device as an example of a flat-panel display, the principles of the invention is applicable to any other display device that has pixels arranged in rows and columns, such as a plasma display, an EL (electroluminescent) display, a field emission display (FED) or a mechanical display. The invention is not restricted by the material and type of a flat-panel display.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display device comprising:

a substrate;

a plurality of pixels arranged in rows and columns on said substrate;

a plurality of signal lines for providing image signals to said plurality of pixels on a column by column basis;

a plurality of row address lines for providing row address signals to said plurality of pixels on a row-by-row basis; and a plurality of rewrite signal lines for providing rewrite signals to said plurality of pixels on a column-by-column basis, each of said plurality of pixels comprising:

a plurality of memory elements for retaining said image signals sent over said plurality of signal lines;

selection means for selecting one of said plurality of memory elements;

rewrite direction means connected to a corresponding one of said plurality of rewrite signal lines to receive a rewrite signals therefrom, said rewrite direction means being responsive to said rewrite signals to direct said plurality of memory elements to rewrite contents thereof; and a display element for displaying a dot at a brightness corresponding to contents of a selected one of said plurality of memory elements;

wherein said selection means selects one of said plurality of memory elements when receiving a row address signal from a corresponding one of said plurality of row address lines and, at the same time, an image signal from a corresponding one of said plurality of signal lines, and in a case where said rewrite direction means directs to rewrite said contents of said selected one of said plurality of memory elements, said image signal from said corresponding one of said plurality of signal lines is written into said selected one of said plurality of memory elements and one of said plurality of memory elements rewritten at the latest is selected, contents of which are provided to said display element for display.

2. The display device according to claim 1, further comprising:

a plurality of column address lines for providing column address signals to said plurality of pixels on a column-by-column basis;

a plurality of memory selection signal lines for providing selection signals for driving said selection means;

and a memory selection controller for driving said plurality of memory selection signal lines, said memory selection controller providing said selection signals for driving said selection means to said plurality of memory selection signal lines in synchronism with said row and said column address signals.

3. The display device according to claim 1, wherein, when a first image signal for one pixel in a previous frame is stored in one of said plurality of memory elements and a second image signal for a pixel in a current frame corresponding to said one pixel in the previous frame is substantially the same as said first image signal, said selection means selecting said one of said plurality of memory elements which stores said first image signal and provides said first image signal to said display element.

4. The display device according to claim 3, wherein said first image signal is a background image signal.

5. The display device according to claim 1, wherein an image signal stored in at least one of said plurality of memory elements is an image signal for an image other than a multiwindow image currently displayed.

6. The display device according to claim 1, wherein at least one of said plurality of memory elements retains data processed in a background by a host system for providing said image signals.

7. The display device according to claim 1, wherein said plurality of memory elements of each of said plurality of pixels have a storage capacity large enough to retain an image corresponding to more pixels than said plurality of pixels arranged on said substrate, and such an image is stored in said plurality of memory elements and displayed by being switched per substantially the number of said plurality of pixels on said substrate to thereby display said image corresponding to more pixels than said plurality of pixels on said substrate.

8. The display device according to claim 1, wherein said one of said plurality of memory elements rewritten at the latest is said selected one of said plurality of memory elements into which said image signal from said corresponding one of said plurality of signal lines.

9. A display device comprising:

a substrate;

a plurality of pixels arranged in rows and columns on said substrate; and a plurality of signal lines for providing image signals to said plurality of pixels on a column-by-column basis, each of said plurality of pixels comprising:

a plurality of memory elements for retaining said image signals sent over a corresponding one of said plurality of signal lines;

selection means for selecting one of said plurality of memory elements; and a display element for displaying a dot at a brightness corresponding to contents of a selected one of said plurality of memory elements;

wherein said plurality of memory elements in each of said plurality of pixels form a first memory circuit including at least one memory element and a second memory circuit including of at least one memory element, said first memory circuit stores an image signal for a right eye and said second memory circuit stores an image signal for a left eye, and said selection means switches between said first and said second memory circuit at high speed to thereby provide a stereoscopic display.

10. A display device comprising:

a substrate;

a plurality of pixels arranged in rows and columns on said substrate;

a plurality of first signal lines arranged in said columns;

a plurality of second signal lines arranged in said columns, each of said second signal lines being paired with a respective one of said plurality of first signal lines;

a plurality of first control lines arranged in said columns;

a plurality of second control lines arranged in said columns, each of said second control lines being paired with a respective one of said plurality of first control lines, a plurality of address lines arranged in said rows; and a plurality of row control lines arranged in said rows, each of said row control lines being paired with a respective one of said plurality of address lines, each of said plurality of pixels including:

a display element having a pixel electrode;

a first switch having a first conduction path, one end of said first conduction path being connected to a corresponding one of said plurality of first signal lines, conduction of said first conduction path being controlled by a corresponding one of said plurality of address lines;

a memory circuit having an input terminal and an output terminal, said input terminal being connected to the other end of said first conduction path and said memory circuit including at least one memory element;

a second switch having a second conduction path, one end of said second conduction path being connected to said output terminal of said memory circuit, conduction of said second conduction path being controlled by a corresponding one of said plurality of first control lines;

a third switch having a third conduction path, one end of said third conduction path being connected to the other end of said second conduction path, the other end of said third conduction path being connected to said pixel electrode, conduction of said third conduction path being controlled by a corresponding one of said plurality of row control lines;

a fourth switch having a fourth conduction path, one end of said fourth conduction path being connected to said pixel electrode, conduction of said fourth conduction path being controlled by said corresponding one of said plurality of row control lines;

a fifth switch having a fifth conduction path, one end of said fifth conduction path being connected to the other end of said fourth conduction path and the other end of said fifth conduction path being connected to a corresponding one of said plurality of second signal lines, conduction of said fifth conduction path being controlled by a corresponding one of said plurality of second control lines.

11. The display device according to claim 10, wherein said memory circuit includes at least two memory elements, a synchronizing signal input terminal to receive a synchronizing signal for selecting a desired one of said memory elements at data entry, and a select signal input terminal to receive a select signal to select a desired one of said memory elements at data output.

12. The display device according to claim 11, wherein said memory circuit in each of said plurality of pixels stores at least two color signals, and said select signal is changed at regular intervals to thereby cause said display element to display an image at a gray level using said at least two color signals.

13. The display device according to claim 11, further comprising a data transfer line connected between said memory circuit and another memory circuit included in neighboring one of said plurality of pixels, said data transfer line allowing data retained in said memory circuit to be transferred to said memory circuit of said neighboring one of said plurality of pixels and vice versa.

14. The display device according to claim 13, wherein said data are color information which are able to be transferred from said memory circuit to said another memory circuit to effect spatial modulation.

15. A display device comprising:

a substrate;

a plurality of pixels arranged in rows and columns on said substrate;

a plurality of signal lines for providing an image signal to said plurality of pixels on a column-by-column basis;

a signal line driver for driving said plurality of signal lines;

first storage means for retaining an externally input image signal as a first record signal; and a subtracter for producing a difference signal between said image signal at one point of time and said first record signal prior to said point of time which is retained in said first storage means and outputting said difference signal to said signal line driver, said signal line driver outputting said difference signal as said image signal, and each of said plurality of pixels including:

second storage means for storing a second record signal corresponding to said first record signal stored in said first storage means;

an adder for adding said second record signal stored in said second storage means and said difference signal; and a display element for displaying a dot at a brightness corresponding to an output of said adder.

16. The display device according to claim 15, wherein said first storage means includes a plurality of first memory elements and a first selector for selecting one of said plurality of first memory elements, and wherein said second storage means includes a plurality of second memory elements and a second selector for selecting one of said plurality of second memory elements.

17. The display device according to claim 16, further comprising a select signal driver for driving said second selector on a basis of a result of selection by said first selector.

18. A display device comprising:

a substrate;

a plurality of pixels arranged in rows and columns on said substrate;

a plurality of address lines arranged in rows;

a plurality of signal lines arranged in columns;

a plurality of row scanning lines arranged in rows;

a plurality of column scanning lines arranged in columns;

a vertical scanner for driving each of said plurality of row scanning lines in sequence;

a horizontal scanner for driving each of said plurality of column scanning lines in sequence; and operation means for performing operations on position data obtained through said vertical scanner and said horizontal scanner to obtain coordinate data at a pixel location that is specified by an external light signal, each of said plurality of pixels comprising:

a first memory circuit selected by a corresponding one of said plurality of address lines for storing an image signal sent over a corresponding one of said plurality of signal lines;

a photoelectric conversion element for sensing presence or absence of said external light signal to produce a detect signal in the presence of said external light signal;

a second memory circuit selected by a corresponding one of said plurality of row scanning lines for storing said detect signal from said photoelectric conversion element and outputting said detect signal onto a corresponding one of said plurality of column scanning lines;

an OR circuit for taking a logical sum of said image signal retained in said first memory circuit and said detect signal retained in said second memory circuit to output a logical sum signal; and a display element for displaying a dot at a brightness corresponding to said logical sum signal from said OR circuit.

19. The display device according to claim 18, wherein said first memory circuit includes a plurality of memory elements.

20. The display device according to claim 18, further comprising a digital-to-analog converter connected between said OR circuit and said display element.

* * * * *